US007425523B2

(12) United States Patent
Ikemizu et al.

(10) Patent No.: US 7,425,523 B2
(45) Date of Patent: Sep. 16, 2008

(54) THERMAL TRANSFER RECORDING MATERIAL AND THERMAL TRANSFER RECORDING METHOD

(75) Inventors: Dai Ikemizu, Tokyo (JP); Emiko Kataoka, Tokyo (JP); Takatugu Suzuki, Tokyo (JP); Kazuya Yoshida, Tokyo (JP); Hiroyuki Yamashita, Tokyo (JP)

(73) Assignee: Dai Nippon Printing Co., Ltd. (JP)

( * ) Notice: Subject to any disclaimer, the term of this patent is extended or adjusted under 35 U.S.C. 154(b) by 404 days.

(21) Appl. No.: 11/172,704

(22) Filed: Jul. 1, 2005

(65) Prior Publication Data

US 2006/0003892 A1 Jan. 5, 2006

(30) Foreign Application Priority Data

Jul. 5, 2004 (JP) ..... 2004-197521

(51) Int. Cl.
*B41M 5/136* (2006.01)

(52) U.S. Cl. ..... 503/218; 503/217

(58) Field of Classification Search ..... None
See application file for complete search history.

(56) References Cited

U.S. PATENT DOCUMENTS 6,337,304 B1 * 1/2002 Yoshizawa et al. ..... 503/227
6,713,432 B2 * 3/2004 Ikemizu et al. ..... 503/227

FOREIGN PATENT DOCUMENTS

JP 03-143684 * 6/1991
JP 03-143686 * 6/1991

* cited by examiner

*Primary Examiner*—Bruce H Hess
(74) *Attorney, Agent, or Firm*—Lucas & Mercanti, LLP

(57) ABSTRACT

A thermal transfer recording material contains at least one colorant represented by the following general formula (II), General formula (II)

wherein $R_{21}$ and $R_{22}$ each represent a substituted or unsubstituted aliphatic group; $R_{23}$ represents a substituent; n represents an integer of 0 to 4; when n is 2 or more, $R_{23}$ is the same or different each other; $R_{25}$ and $R_{26}$ represent alkyl groups respectively; and at least one of $R_{25}$ and $R_{26}$ represents a secondary alkyl group.

8 Claims, 3 Drawing Sheets

THERMAL TRANSFER RECORDING MATERIAL AND THERMAL TRANSFER RECORDING METHOD

BACKGROUND OF THE INVENTION

1. Field of the Invention

The present invention relates to a thermal transfer recording material and a thermal transfer recording method 2. Description of Related Art Conventionally, color image recording by inkjet, electrophotography, thermal transfer, silver halide photosensitive materials and the like has been studied as methods for obtaining color hard copies. Among them, the image recording using a thermal transfer recording material has advantages such as easy operation and maintenance, downsized apparatus, potential reduction in cost and further inexpensive running cost.

In the image recording using this thermal transfer recording material, a colorant used for the thermal transfer recording material (also referred to as a thermal transfer material) is important. For the purpose of improving stability, particularly fixable property and light resistance of an image obtained, thermal transfer recording materials using thermally diffusible colorants (referred to as post-chelate colorants) capable of being chelated and a image forming method, i.e. thermal transfer recording methods, have been proposed, and described in, for example, JP SHO 59-78893 A, JP SHO 59-109349 A and JP SHO 60-2398 A. An image formed using the post-chelate colorant shown in the above documents is excellent in light resistance and fixable property, but is not sufficiently satisfied in sensitivity of the thermal transfer material and storage stability of the material itself. Furthermore, since a hue difference between the post-chelate colorant and the metal chelate colorant is large, when a chelate reaction is insufficient upon the image formation, absorption of the unreacted post-chelate colorant remains, or the formed metal chelate colorant itself is irregularly absorbed. Therefore, when a full color image is obtained, it has been necessary to further improve color reproducibility.

Thus, in JP HEI 3-143684 A, JP HEI 3-143686 A, Tokugan Hei 9-257947, and Tokugan Hei 11-60123, the thermal transfer recording materials using the colorants having pyrazolopyrimidine-7-one center nuclei have been proposed. In these colorants, problematic points as the above are improved to some extent, but the improvement is not sufficient, and in particular, the storage stability (heat and humidity resistance) under a high temperature and humidity condition and the storage stability under light irradiation (light resistance) are insufficient. Therefore, further improvement has been desired.

Furthermore recently, for responding to speeding up of image printing, it is regarded as important to express dark and light with lower energy. That is, with respect to the colorant, the colorant with high heat responsibility, i.e., high sensitivity has been desired earnestly. However, including a balance with the storage stability, the above colorants do not reach a sufficient level yet.

SUMMARY OF THE INVENTION

Based on the above various problems, an object of the present invention is to provide a thermal transfer recording material for obtaining an image which is excellent in sensitivity, fixable property and image stability, and a thermal transfer recording method using the recording material.

According to a first aspect of the present invention, the thermal transfer recording material comprises at least one colorant represented by the following general formula (II):

General formula (II)

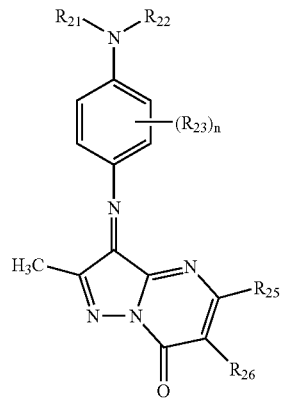

In the formula, $R_{21}$ and $R_{22}$ each represent a substituted or unsubstituted aliphatic group, $R_{23}$ represents a substituent, and n represents an integer of 0 to 4. When n is 2 or more, multiple $R_{23}$ may be the same or different. $R_{25}$ and $R_{26}$ represent alkyl groups, but at least one of $R_{25}$ and $R_{26}$ represents a secondary alkyl group.

Preferably, the colorant of the general formula (II) is a colorant represented by the following general formula (III), (IV) or (V), General formula (III)

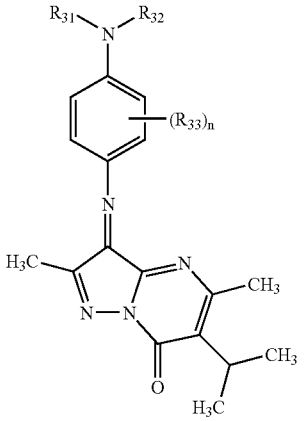

wherein $R_{31}$ and $R_{32}$ each represent a substituted or unsubstituted aliphatic group; $R_{33}$ represents a substituent; n represents an integer of 0 to 4; and when n is 2 or more, the $R_{33}$ are the same or different each other;

General formula (IV)

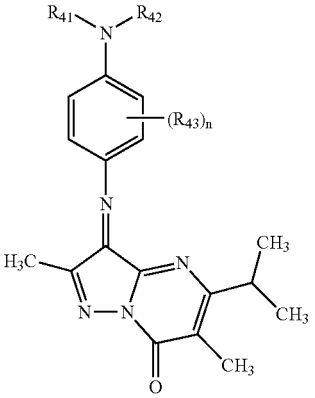

wherein $R_{41}$ and $R_{42}$ each represent a substituted or unsubstituted aliphatic group, $R_{43}$ represents a substituent, and n represents an integer of 0 to 4. When n is 2 or more, $R_{43}$ are the same or different each other; and General formula (V)

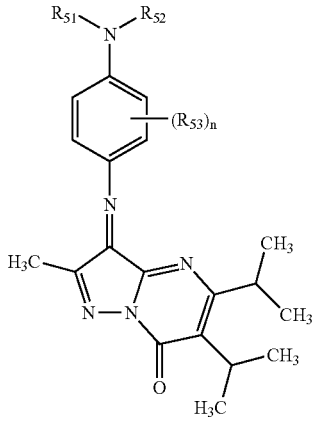

wherein $R_{51}$ and $R_{52}$ each represent a substituted or unsubstituted aliphatic group, $R_{53}$ represents a substituent, and n represents an integer of 0 to 4. When n is 2 or more, $R_{53}$ are the same or different each other.

Preferably, the colorant represented by at least one of the above general formulae (II) to (V) has a molecular weight of 300 to 410.

Preferably, the colorant represented by the above general formula (IV) is a colorant of the following structure (1).

Structural formula (1)

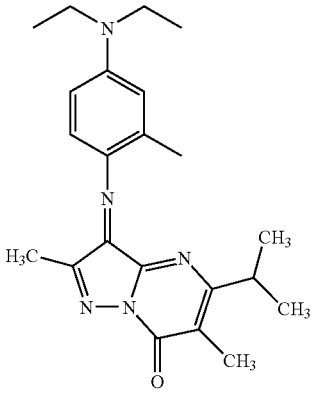

According to a second aspect of the invention, a thermal transfer recording method to form an image, comprises: lapping an image receiving material over a thermal transfer recording material which comprises a colorant providing layer containing at least one colorant represented by the following general formula (II); and heating the thermal transfer recording material in accordance with image information, General formula (II)

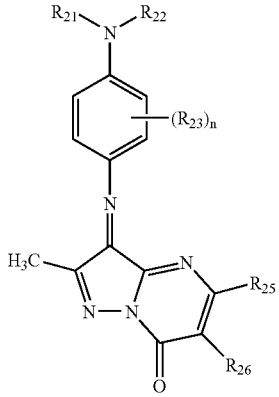

wherein $R_{21}$ and $R_{22}$ each represent a substituted or unsubstituted aliphatic group; $R_{23}$ represents a substituent; n represents an integer of 0 to 4; when n is 2 or more, $R_{23}$ are the same or different each other; $R_{25}$ and $R_{26}$ represent alkyl groups respectively; and at least one of $R_{25}$ and $R_{26}$ represents a secondary alkyl group.

Preferably, the image receiving material comprises a colorant image-receiving layer containing a metal ion-containing compound on a support, and the image is a metal chelate colorant image.

According to a third aspect of the invention, a thermal transfer recording material comprising: at least one metal chelate colorant generated by a reaction of a metal ion-containing compound with a colorant represented by the following general formula (II), General formula (II)

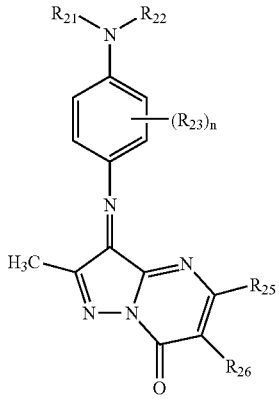

wherein $R_{21}$ and $R_{22}$ each represent a substituted or unsubstituted aliphatic group; $R_{23}$ represents a substituent; n represents an integer of 0 to 4; when n is 2 or more, $R_{23}$ are the same or different each other; $R_{25}$ and $R_{26}$ represent alkyl groups respectively; and at least one of $R_{25}$ and $R_{26}$ represents a secondary alkyl group.

According to a fourth aspect of the invention, thermal transfer recording method using the above-described thermal transfer recording material comprising the metal chelate colorant.

According to the invention, it becomes possible to provide a thermal transfer recording material and image receiving sheet which have high image quality (improved image bleeding), high sensitivity, and furthermore, have superior storage stability and image stability (light resistance). Further according to the invention, it becomes possible to provide a metal chelate colorant image which has high sensitivity and superior resistance to light, heat and moisture.

BRIEF DESCRIPTION OF THE DRAWINGS

The present invention will be further appreciated by the following detailed description and attached drawings, but these are exclusively for illustration and do not limit the scope of the invention. Here.

DETAILED DESCRIPTION OF PREFERRED EMBODIMENTS

Figure 1A:
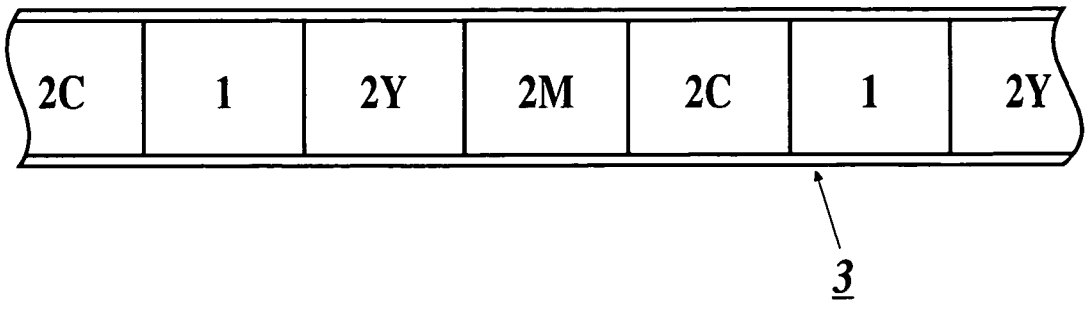
FIGS. 1A and 1B is a plane view showing an example of a mode of an ink layer and a reheating layer provided in an ink sheet used for a method of the present invention.

The present invention will be described in detail below.

First, compounds used for the invention will be described in detail.

In the general formula (II), $R_{21}$ and $R_{22}$ each represent a substituted or unsubstituted aliphatic group, and $R_{21}$ and $R_{22}$ may be the same or different. Examples of the aliphatic groups include alkyl, cycloalkyl, alkenyl, alkynyl and the like. Examples of the alkyl groups can include methyl, ethyl, propyl, i-propyl and the like. Groups capable of substituting these alkyl groups include straight or branched alkyl groups (e.g., methyl, ethyl, i-propyl, t-butyl, n-dodecyl, and 1-hexylnonyl), cycloalkyl groups (e.g., cyclopropyl, cyclohexyl, bicyclo[2.2.1]heptyl and adamantyl), and alkenyl groups (e.g., 2-propylene, oleyl), aryl groups (e.g., phenyl, ortho-tolyl, ortho-anisyl, 1-naphthyl, 9-anthranil), heterocyclic groups (e.g., 2-tetrahydrofulyl, 2-thiophenyl, 4-imidazolyl and 2-pyridyl), halogen atoms (e.g., fluorine, chlorine, bromine), cyano group, nitro group, hydroxy group, carbonyl groups (e.g., alkylcarbonyl such as acetyl, trifluoroacetyl and pivaloyl, arylcarbonyl such as benzoyl, pentafluorobenzoyl and 3,5-di-t-butyl-hydroxybenzoyl), oxycarbonyl groups (e.g., alkoxycarbonyl such as methoxycarbonyl, cyclohexyloxycarbonyl and n-dodecyloxycarbonyl, aryloxycarbonyl such as phenoxycarbonyl, 2,4-di-t-amylphenoxycarbonyl and 1-naphthyloxycarbonyl, heterocyclic oxycarbonyl such as 2-pyridyloxycarbonyl and 1-phenylpyrazolyl-5-oxycarbonyl), carbamoyl groups (e.g., alkylcarbamoyl such as dimethylcarbamoyl and 4-(2,4-di-t-amylphenoxy)butylaminocarbonyl, arylcarbamoyl such as phenylcarbamoyl and 1-naphthylcarbamoyl), alkoxy groups (e.g., methoxy, 2-ethoxyethoxy), aryloxy groups (e.g., phenoxy, 2,4-di-t-amylphenoxy, 4-(4-hydroxyphenylsulfonyl)phenoxy), heterocyclic oxy groups (e.g., 4-pyridyloxy, 2-hexahydropyranyloxy), carbonyloxy groups (e.g., alkylcarbonyloxy such as acetyloxy, trifluoroacetyloxy and pivaloyloxy, arylcarbonyloxy such as benzoyloxy and pentafluorobenzoyloxy), urethane groups (e.g., alkylurethane such as N,N-dimethylurethane, arylurethane such as N-phenylurethane and N-(p-cyanophenyl)urethane, sulfonyloxy groups (e.g., alkylsulfonyloxy such as methanesulfonyloxy, trifluoromethanesulfonyloxy and n-dodecanesulfonyloxy, arylsulfonyloxy such as benzenesulfonyloxy and p-toluenesulfonyloxy), amino groups (e.g., alkylamino such as dimethylamino, cyclohexylamino and n-dodecylamino, arylamino such as anilino and p-t-octylanilino), sulfonylamino groups (e.g., alkylsulfonylamino such as methanesulfonylamino, heptafluoropropanesulfonylamino and n-hexadecylsulfonylamino, arylsulfonylamino such as p-toluenesulfonylamino and pentafluorobenzenesulfonylamino), sulfamoylamino groups (e.g., alkylsulfamoylamino such as N-dimethylsulfamoylamino, arylsulfamoylamino such as N-phenylsulfamoylamino), acylamino groups (e.g., alkylcarbonylamino such as acetylamino and myristoylamino, arylcarbonylamino such as benzoylamino), ureido groups (e.g., alkylureido such as N,N-dimethylaminoureido, arylureido such as N-phenylureido and N-(p-cyanophenyl)ureido), sulfonyl groups (e.g., alkylsulfonyl such as methanesulfonyl and trifluoromethanesulfonyl, arylsulfonyl such as p-toluenesulfonyl), sulfamoyl groups (e.g., alkylsulfamoyl such as dimethylsulfamoyl and 4-(2,4-di-t-amylphenoxy)butylaminosulfamoyl, arylsulfamoyl such as phenylsulfamoyl), alkylthio groups (e.g., methylthio, t-octylthio), arylthio groups (e.g., phenylthio), and heterocyclic thio groups (e.g., 1-phenyltetrazole-5-thio, 5-methyl-1,3,4-oxadiazole-2-thio), and the like.

Examples of the cycloalkyl groups and the alkenyl groups are the same as the above substituents. Examples of the alkynyl groups include 1-propine, 2-butine, 1-hexine and the like.

It is also preferable that $R_{21}$ and $R_{22}$ form a non-aromatic ring structure (e.g., pyrrolidine ring, piperidine ring, morpholine ring, etc.).

$R_{23}$ represents a substituent. Examples of the substituents includes the examples of the substituents for the above $R_{21}$ and $R_{22}$. Among the above substituents, alkyl, cycloalkyl, alkoxy and acylamino are preferable. And n represents an integer of 0 to 4. When n is 2 or more, multiple $R_{23}$ may be the same or different.

$R_{25}$ and $R_{26}$ represent alkyl, and examples thereof include methyl, ethyl, n-propyl, n-butyl, n-pentyl, n-hexyl, n-heptyl, isopropyl, sec-butyl, tert-butyl, 3-heptyl, 2-ethylhexyl and the like. At least one of $R_{25}$ and $R_{26}$ represents a secondary alkyl group, and examples of the secondary alkyl groups include isopropyl, sec-butyl, 3-heptyl, 2-ethylhexyl and the like. The most preferable substituent as the secondary alkyl group of $R_{25}$ and $R_{26}$ is isopropyl. The secondary alkyl group of $R_{26}$ may be substituted, but is substituted with the substituent composed of only carbon and hydrogen atoms, and must not be substituted with the substituent comprising other atom. $R_{25}$ and $R_{26}$ may be the same or different.

In the general formulae (III) to (V), the descriptions for $R_{31}$, $R_{32}$, $R_{41}$, $R_{42}$, $R_{51}$ and $R_{52}$ are the same defined as the description for $R_{21}$ and $R_{22}$ in the above general formula (II). The descriptions for $R_{33}$, $R_{43}$ and $R_{53}$ are the same defined as the description for $R_{23}$ in the above general formula (II).

In the colorants of the general formulae (II) to (V) and the structure (1), to use it for the image formation method of a so-called thermal transfer mode in which the colorant is transferred by heat to obtain the image, it is necessary that transferable property of the colorant is favorable. Generally it is described that the lower the molecular weight of the colorant is, the better the transferable property thereof is. When its molecular weight is too low, there has been a trouble that the colorant is bled with time. In the present invention, as a result of an extensive study, the present inventors have found that there is an optimal value in a molecular weight of a colorant. The molecular weight of the colorant is preferably 300 to 410, and more preferably 320 to 400.

Specific examples of the colorants represented by the general formulae (II) to (V) of the present invention and a corresponding table of the molecular weights are shown below, but the invention is not limited thereto.

(Exemplified compounds)

1

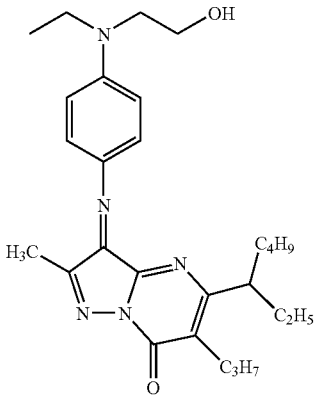

$C_{27}H_{39}N_5O_2$
Mol. Wt: 465.63

2

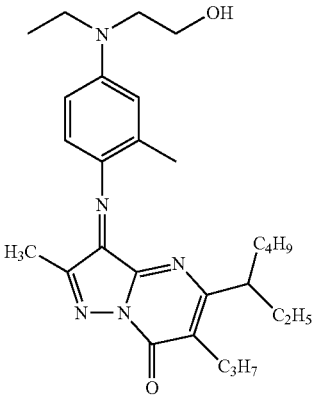

$C_{28}H_{41}N_5O_2$
Mol. Wt.: 479.66

3

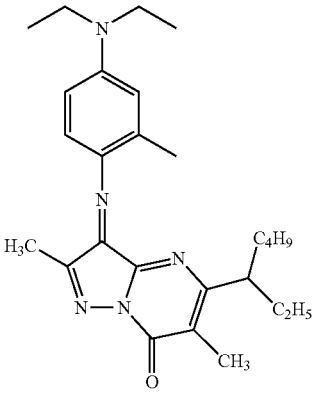

$C_{26}H_{37}N_5O$
Mol. Wt.: 435.60

-continued

4

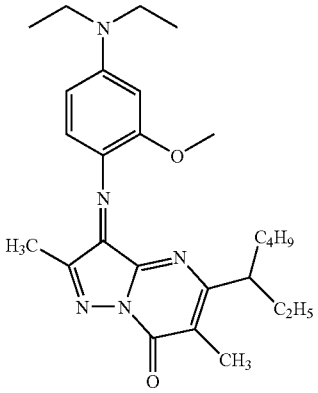

$C_{26}H_{37}N_5O_2$
Mol. Wt.: 451.60

5

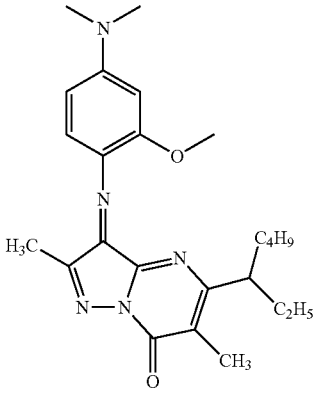

$C_{24}H_{33}N_5O_2$
Mol. Wt.: 423.55

6

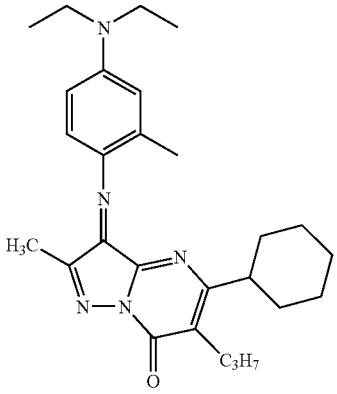

$C_{27}H_{37}N_5O$
Mol. Wt.: 447.62

-continued
7
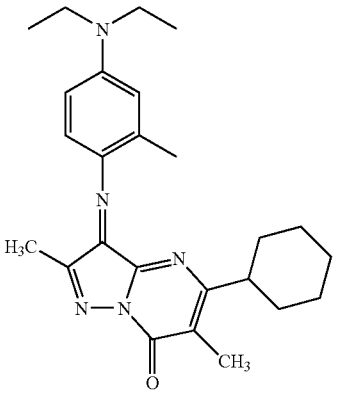
$C_{25}H_{33}N_5O$
Mol. Wt.: 419.56
8
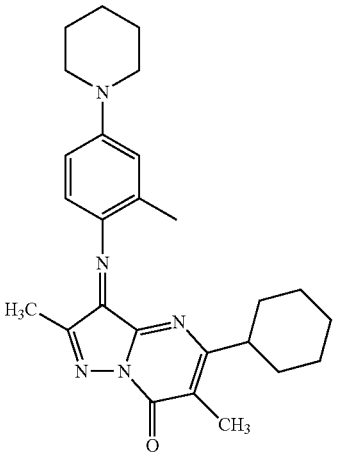
$C_{26}H_{33}N_5O$
Mol. Wt.: 431.57
9
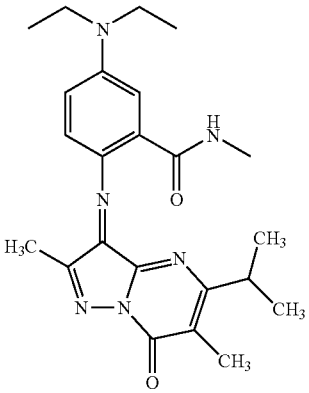
$C_{24}H_{32}N_6O_2$
Mol. Wt.: 436.55
-continued
10
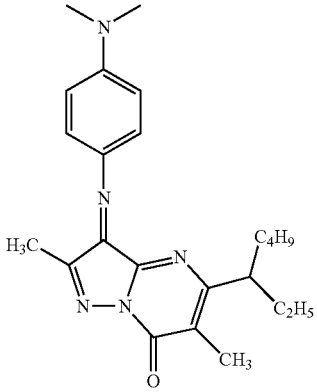
$C_{23}H_{31}N_5O$
Mol. Wt.: 393.53
11
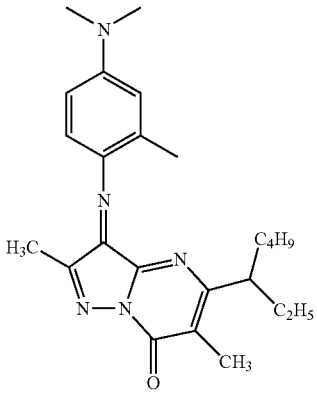
$C_{24}H_{33}N_5O$
Mol. Wt.: 407.55
12
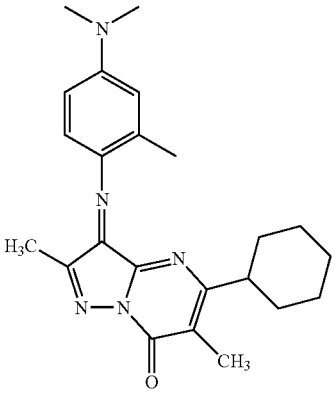
$C_{23}H_{29}N_5O$
Mol. Wt.: 391.51

-continued
13
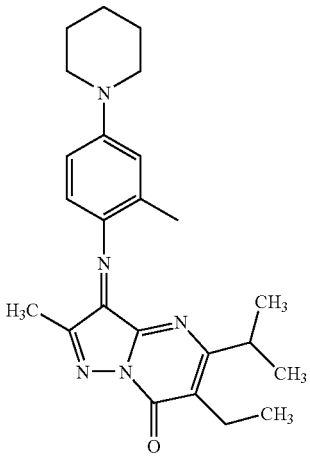
$C_{24}H_{31}N_5O$
Mol. Wt.: 405.54
14
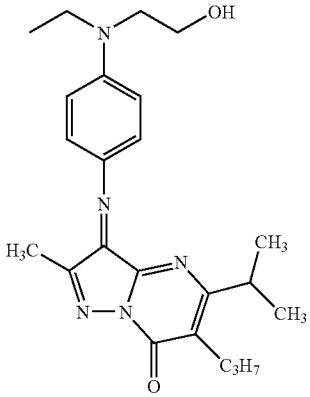
$C_{23}H_{31}N_5O_2$
Mol. Wt.: 409.52
15
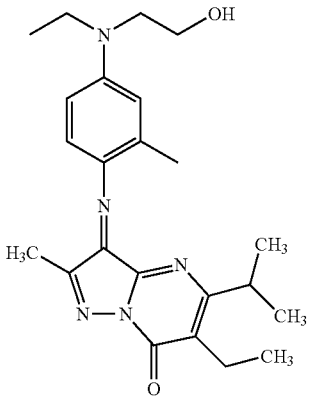
$C_{23}H_{31}N_5O_2$
Mol. Wt.: 409.52
-continued
16
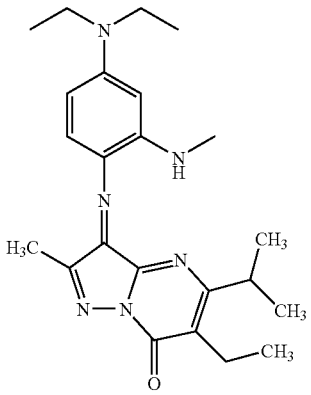
$C_{23}H_{32}N_6O$
Mol. Wt.: 408.54
17
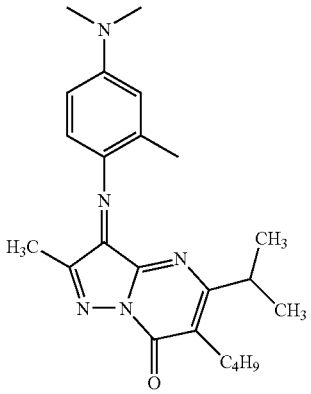
$C_{23}H_{31}N_5O$
Mol. Wt.: 393.53
18
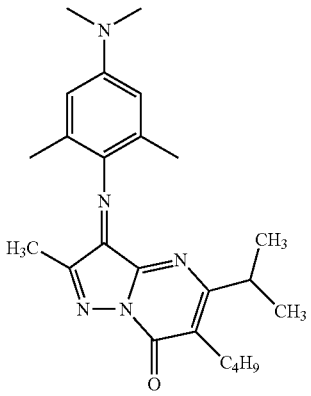
$C_{24}H_{33}N_5O$
Mol. Wt.: 407.55

-continued
19
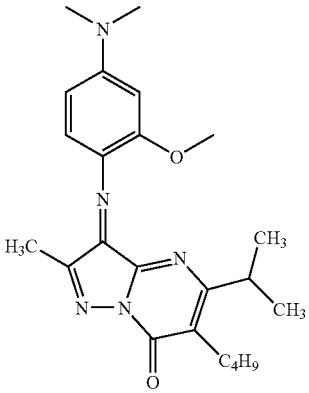
$C_{23}H_{31}N_5O_2$
Mol. Wt.:409.52
20
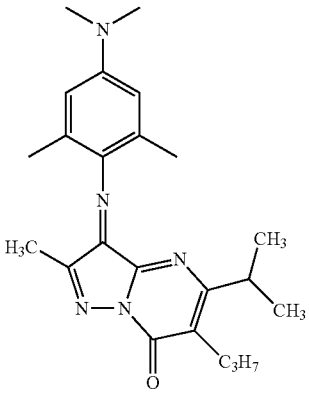
$C_{23}H_{31}N_5O$
Mol. Wt.: 393.53
21
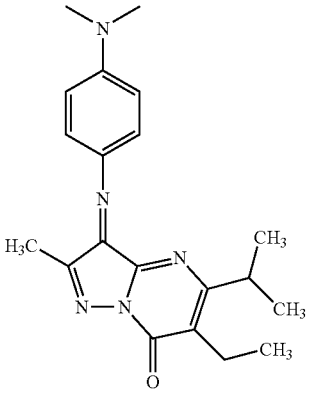
$C_{25}H_{25}N_5O$
Mol. Wt.: 351.45
-continued
22
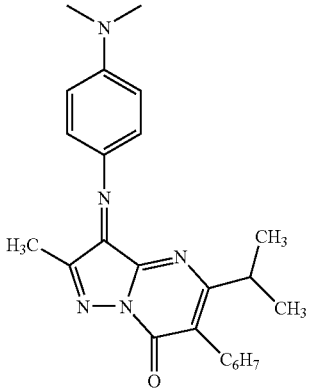
$C_{21}H_{27}N_5O$
Mol. Wt.: 365.47
23
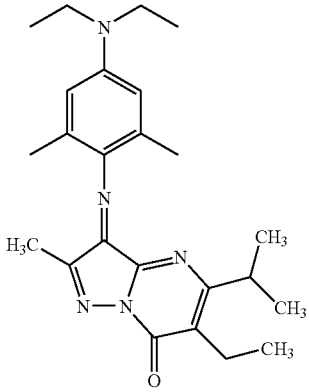
$C_{24}H_{33}N_5O$
Mol. Wt.: 407.55
24
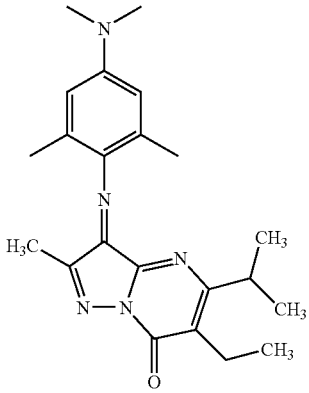
$C_{22}H_{29}N_5O$
Mol. Wt.: 379.50

-continued
25
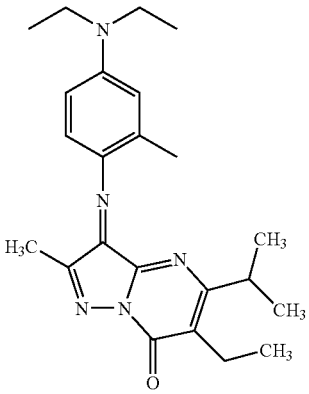
$C_{23}H_{31}N_5O$
Mol. Wt.: 393.53
26
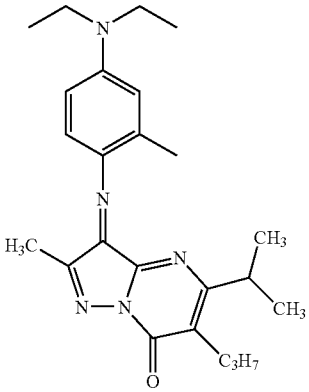
$C_{24}H_{33}N_5O$
Mol. Wt.: 407.55
27
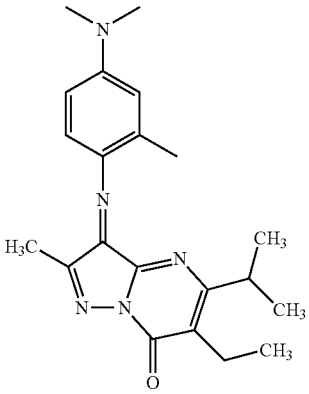
$C_{21}H_{27}N_5O$
Mol. Wt.: 365.47
-continued
28
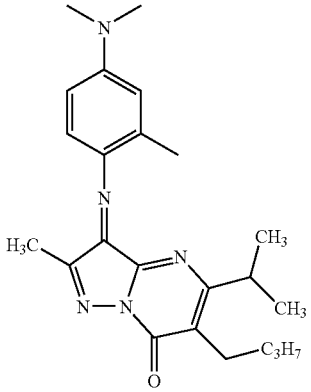
$C_{22}H_{29}N_5O$
Mol. Wt.: 379.50
29
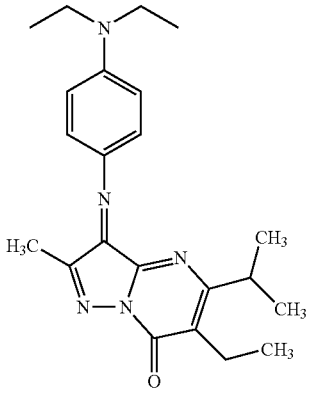
$C_{22}H_{29}N_5O$
Mol. Wt.: 379.50
30
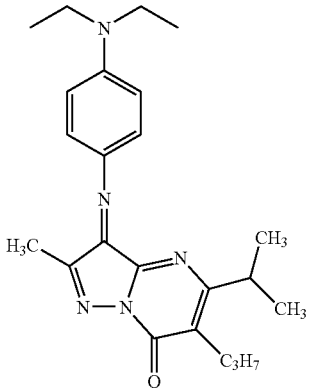
$C_{23}H_{31}N_5O$
Mol. Wt.: 393.53

-continued
31
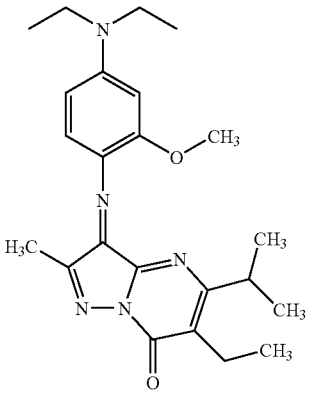
$C_{23}H_{31}N_5O_2$
Mol. Wt.: 409.52
32
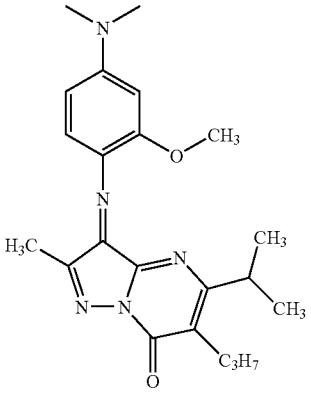
$C_{22}H_{29}N_5O_2$
Mol. Wt.: 395.50
33
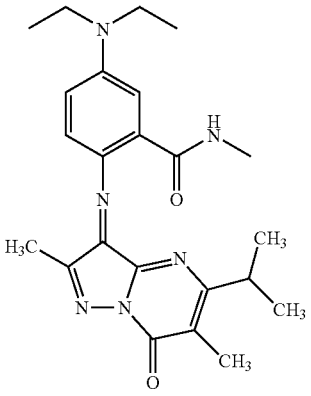
$C_{23}H_{30}N_5O_2$
Mol. Wt.: 422.52
-continued
34
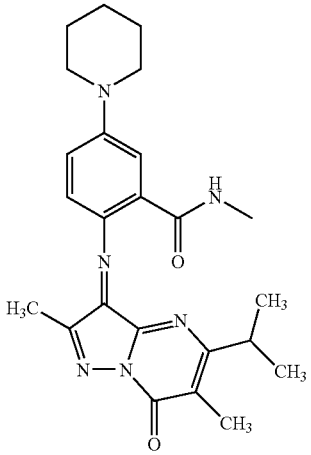
$C_{24}H_{30}N_5O_2$
Mol. Wt.: 434.53
35
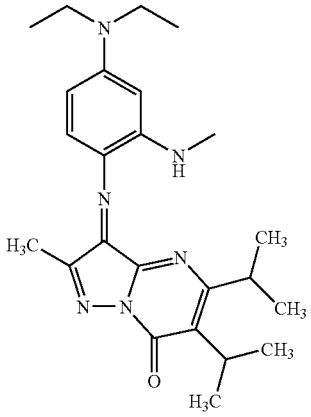
$C_{24}H_{34}N_6O$
Mol. Wt.: 422.57
36
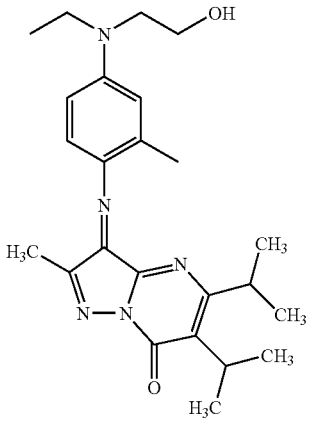
$C_{24}H_{33}N_5O_2$
Mol. Wt.: 423.55

-continued
37
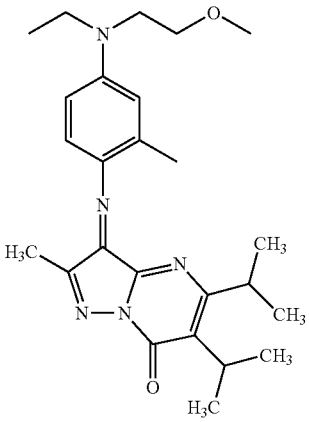
$C_{25}H_{35}N_5O_2$
Mol. Wt.: 437.58
38
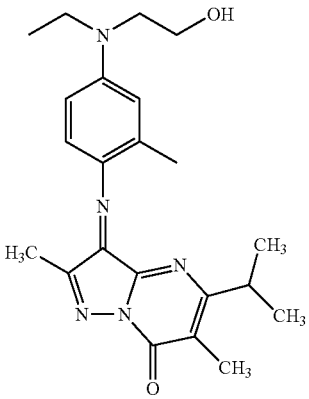
$C_{22}H_{29}N_5O_2$
Mol. Wt.: 395.50
39
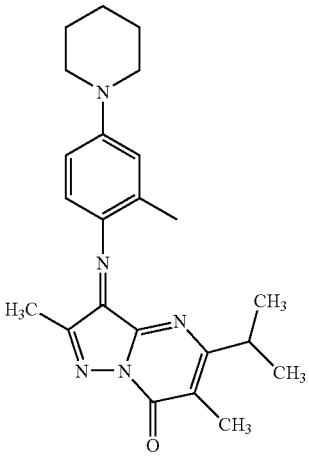
$C_{23}H_{29}N_5O$
Mol. Wt.: 391.51
-continued
40
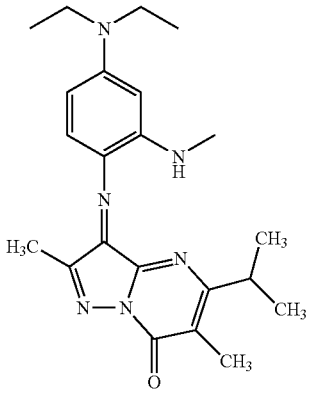
$C_{22}H_{30}N_6O$
Mol. Wt.: 394.51
41
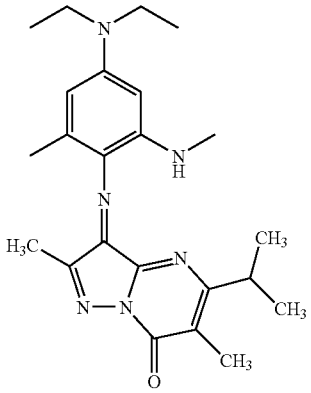
$C_{23}H_{32}N_6O$
Mol. Wt.: 408.54
42
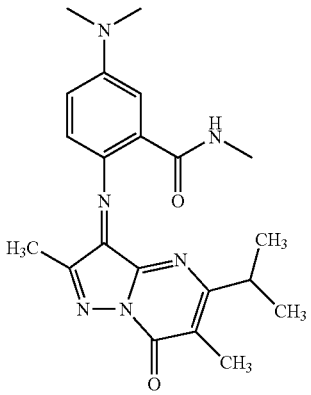
$C_{21}H_{26}N_5O_2$
Mol. Wt.: 394.47

-continued
43
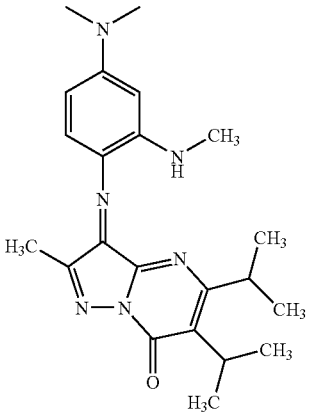
$C_{22}H_{30}N_6O$
Mol. Wt.: 394.51
44
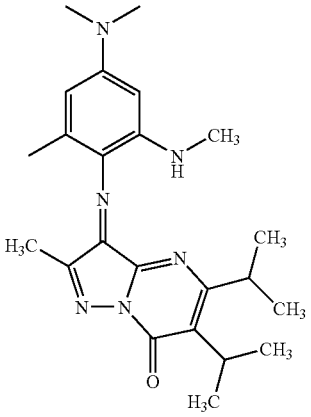
$C_{23}H_{32}N_6O$
Mol. Wt.: 408.54
45
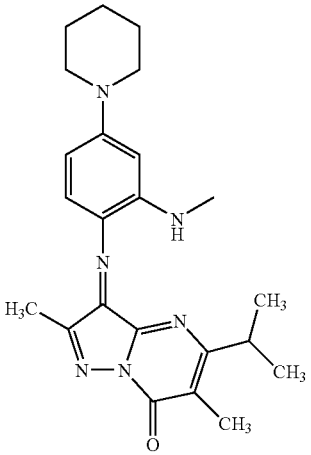
$C_{23}H_{30}N_6O$
Mol. Wt.: 406.52
-continued
46
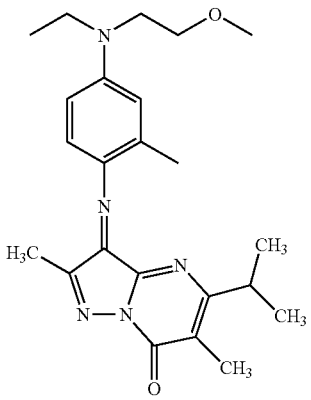
$C_{23}H_{31}N_5O_2$
Mol. Wt.: 409.52
47
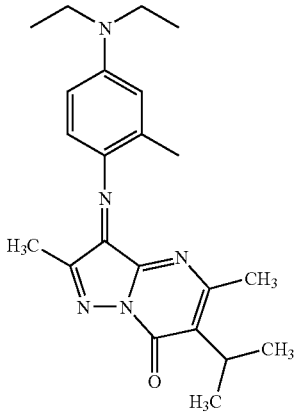
$C_{22}H_{29}N_5O$
Mol. Wt.: 379.50
48
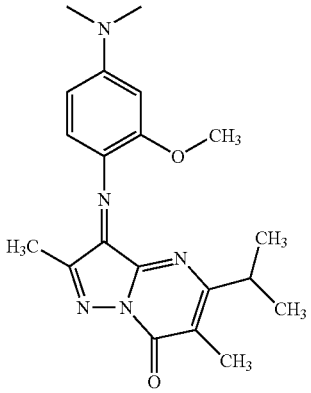
$C_{20}H_{25}N_5O_2$
Mol. Wt.: 367.44

-continued
49
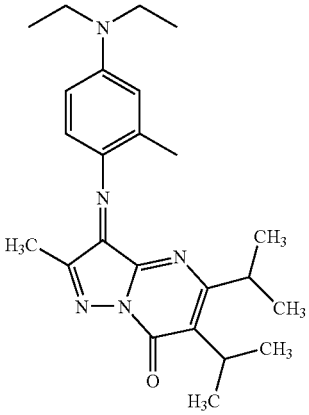
$C_{24}H_{33}N_5O$
Mol. Wt.: 407.55
50
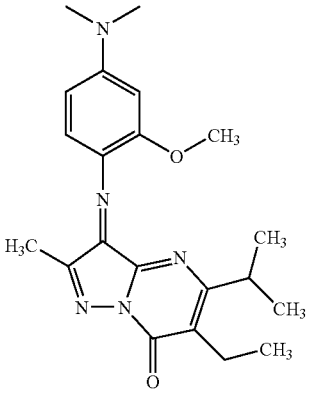
$C_{21}H_{27}N_5O_2$
Mol. Wt.: 381.47
51
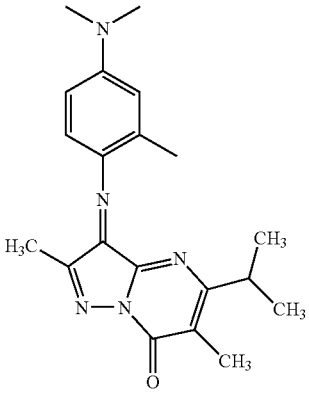
$C_{20}H_{25}N_5O$
Mol. Wt.: 351.45
-continued
52
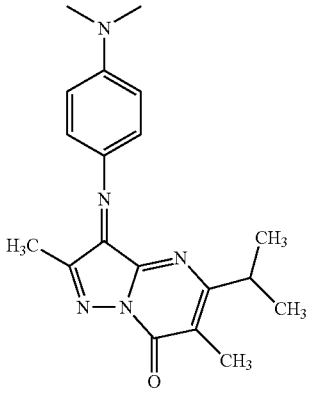
$C_{19}H_{23}N_5O$
Mol. Wt.: 337.42
53
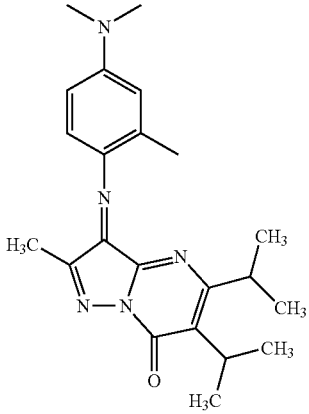
$C_{22}H_{29}N_5O$
Mol. Wt.: 379.50
54
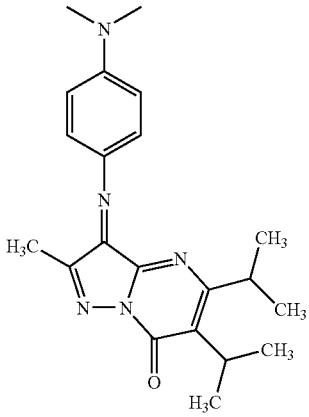
$C_{21}H_{27}N_5O$
Mol. Wt.: 365.47

-continued
55
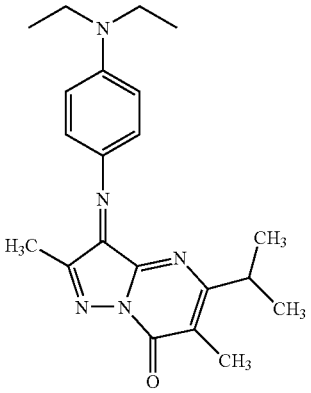
$C_{21}H_{27}N_5O$
Mol. Wt.: 365.47
56
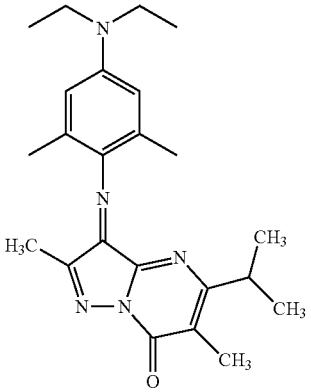
$C_{23}H_{31}N_5O$
Mol. Wt.: 393.53
57
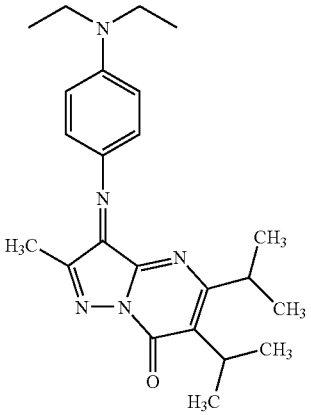
$C_{23}H_{31}N_5O$
Mol. Wt.: 393.53
-continued
58
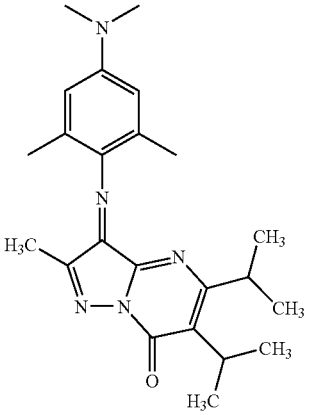
$C_{23}H_{31}N_5O$
Mol. Wt.: 393.53
59
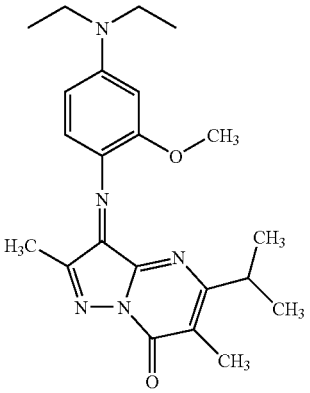
$C_{22}H_{29}N_5O_2$
Mol. Wt.: 395.50
60
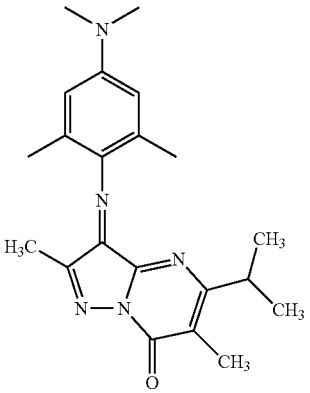
$C_{21}H_{27}N_5O$ Mol.
Wt.: 365.47

-continued
61
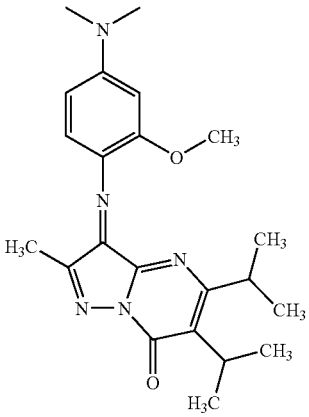
$C_{22}H_{29}N_5O_2$
Mol. Wt.: 395.50
62
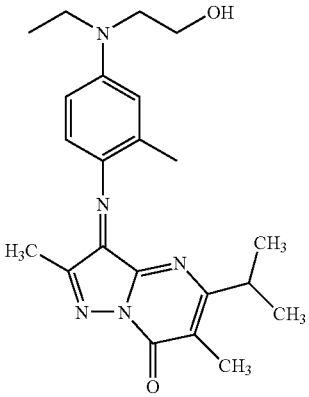
$C_{22}H_{29}N_5O_2$
Mol. Wt.: 395.50
63
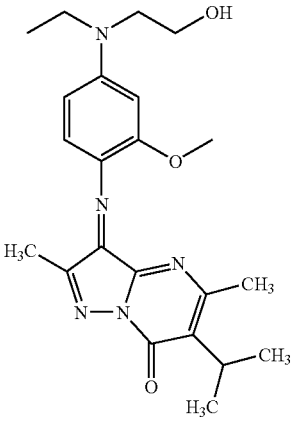
$C_{22}H_{29}N_5O_3$
Mol. Wt.: 411.50
-continued
64
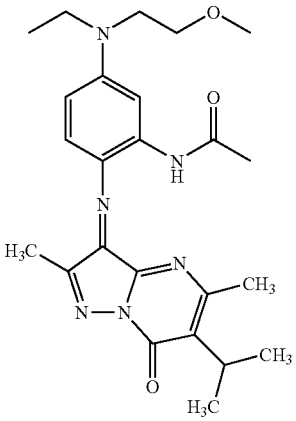
$C_{24}H_{32}N_6O_3$
Mol. Wt.: 452.55
65
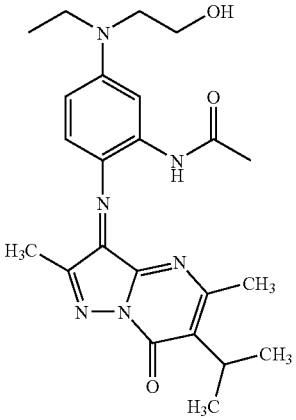
$C_{23}H_{30}N_6O_3$
Mol. Wt.: 438.52
66
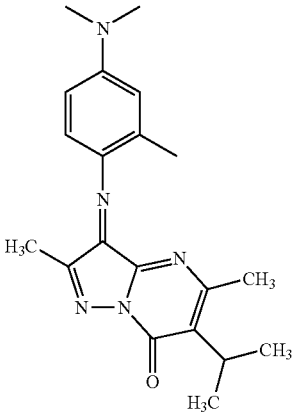
$C_{20}H_{25}N_5O$
Mol. Wt.: 351.45

-continued
67
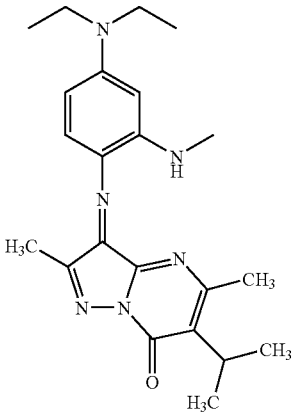
$C_{22}H_{30}N_6O$
Mol. Wt.: 394.51
68
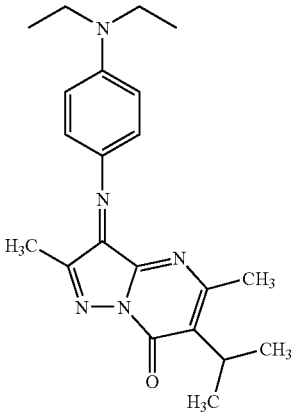
$C_{21}H_{27}N_5O$
Mol. Wt.: 365.47
69
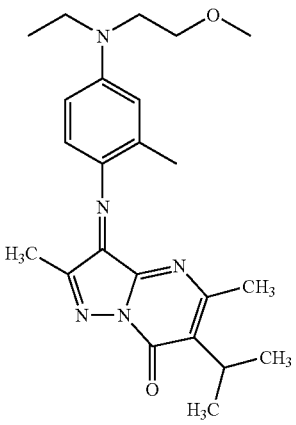
$C_{23}H_{31}N_5O_2$
Mol. Wt.: 409.52
-continued
70
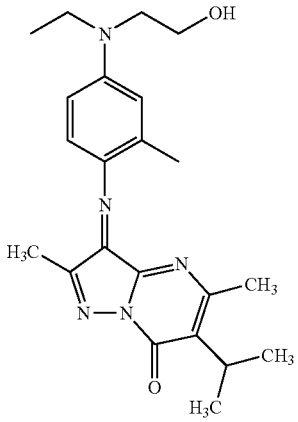
$C_{22}H_{29}N_5O_2$
Mol. Wt.: 395.50
71
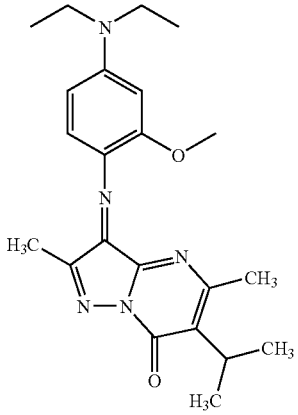
$C_{22}H_{29}N_5O_2$
Mol. Wt.: 395.50
TABLE 1
| Colorant No. | Molecular weight |
|---|---|
| 1 | 465.63 |
| 2 | 479.66 |
| 3 | 435.6 |
| 4 | 451.6 |
| 5 | 423.55 |
| 6 | 447.62 |
| 7 | 419.56 |
| 8 | 431.57 |
| 9 | 436.55 |
| 10 | 393.53 |
| 11 | 407.55 |
| 12 | 391.51 |
| 13 | 405.54 |
| 14 | 409.52 |
| 15 | 409.52 |
| 16 | 408.54 |
| 17 | 393.53 |
| 18 | 407.55 |
| 19 | 409.52 |
| 20 | 393.53 |
| 21 | 351.45 |

TABLE 1-continued

| Colorant No. | Molecular weight |
|---|---|
| 22 | 365.47 |
| 23 | 407.55 |
| 24 | 379.5 |
| 25 | 393.53 |
| 26 | 407.55 |
| 27 | 365.47 |
| 28 | 379.5 |
| 29 | 379.5 |
| 30 | 393.53 |
| 31 | 409.52 |
| 32 | 395.5 |
| 33 | 422.52 |
| 34 | 434.53 |
| 35 | 422.57 |
| 36 | 423.55 |
| 37 | 437.58 |
| 38 | 395.5 |
| 39 | 391.51 |
| 40 | 394.51 |
| 41 | 408.54 |
| 42 | 394.47 |
| 43 | 394.51 |
| 44 | 408.54 |
| 45 | 406.52 |
| 46 | 409.52 |
| 47 | 379.5 |
| 48 | 367.44 |
| 49 | 407.55 |
| 50 | 381.47 |
| 51 | 351.45 |
| 52 | 337.42 |
| 53 | 379.5 |
| 54 | 365.47 |
| 55 | 365.47 |
| 56 | 393.53 |
| 57 | 393.53 |
| 58 | 393.53 |
| 59 | 395.5 |
| 60 | 365.47 |
| 61 | 395.5 |
| 62 | 395.5 |
| 63 | 411.5 |
| 64 | 452.55 |
| 65 | 438.52 |
| 66 | 351.45 |
| 67 | 394.51 |
| 68 | 365.47 |
| 69 | 409.52 |
| 70 | 395.5 |
| 71 | 395.5 |
| structural formula (1) | 379.5 |

The colorant of the general formulae (II) to (V) and the structural formula (1) used for the invention can be synthesized using the methods described in JP 2000-255171 A. For example, in the case of the exemplified compound 47, it can be synthesized in accordance with the following scheme.

Synthesis scheme

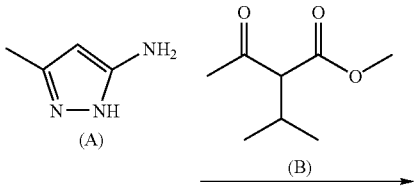

-continued

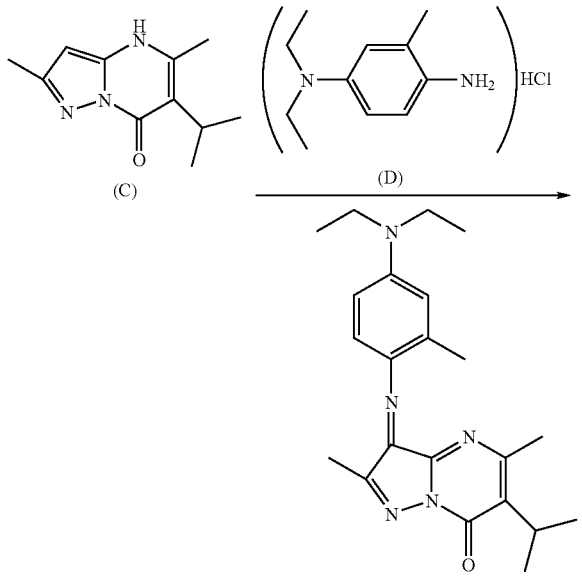

Exemplified compound (47)

Synthesis examples of the exemplified compounds of the invention will be shown below.

SYNTHESIS EXAMPLES

Synthesis Example 1

Synthesis of Exemplified Compound 47

Toluene (230 mL) was added into a reaction vessel into which 46 g (0.474 mol) of aminopyrazole (1), 75 g (0.4741 mol) of keto ester (2) and 10.8 g (0.05689 mol) of p-toluene sulfonate hydrate had been added, and was heated for 1.5 hours with distilling off water, methanol generated by the reaction and the solvent. When 150 mL of acetonitrile was added to the resulting oil product, crystal was precipitated, and thus, this was filtrated to yield 50.1 g of a colorant precursor (3).

Ethyl acetate (12 mL) was added to 3.47 g (0.01693 mol) of the colorant precursor (3), and further 5.38 g (0.05076 mol) of sodium carbonate, 2.5 g of Tracks K-40 (activator) and 1 mL of water were sequentially added thereto, and vigorously agitated in a 45° C. water bath for one hour. A solution in which 4.64 g of an aniline analogue (4) had been dissolved in 12 mL of water and a solution in which 10.3 g of sodium persulfate and 9.16 g of sodium carbonate had been dissolved in 36 mL of water were alternately added in a small portion. After the addition, the reaction solution was vigorously agitated in 45° C. for additional one hour, and subsequently cooled. Precipitated crystal was filtrated to yield 2.16 g of the green crystal of the exemplified compound 47 having metallic luster (yield 33.6%).

The structure was identified by NMR spectrum and mass spectrum. In an acetone solution, λmax of the exemplified compound 47 was 580 nm, its molar extinction coefficient (ε) was 52300, and its melting point was 201° C.

Synthesis Example 2

Synthesis of Exemplified Compound 49

A colorant precursor was synthesized by the same formulation as in the exemplified compound 47, and the aniline analogue (4) was reacted to yield 4.49 g of the exemplified compound 49 (yield 65.1%). In an acetone solution, λmax of the exemplified compound 49 was 580 nm, its molar extinction coefficient (ϵ) was 48700, and its melting point was 243° C.

Synthesis Example 3

Synthesis of Structural Formula 1

A colorant precursor was synthesized by the same formulation as in the exemplified compound 47, and the aniline analogue (4) was reacted to yield 4.66 g of the structural formula 1 (yield 72.5%). In an acetone solution, λmax of the structural formula 1 was 580 nm, its molar extinction coefficient (ϵ) was 49700, and its melting point was 213° C.

The other exemplified compounds were synthesized by the same method.

The synthesized compounds are shown in Table 2.

TABLE 2

| SYNTHESIS EXMAPLE | COLORANT NO. | MOLECULAR WEIGHT | λMAX | ϵ | MELTING POINT | YIELD |
|---|---|---|---|---|---|---|
| 4 | 3 | 435.6 | 581 | 49300 | 222° C. | 56.8% |
| 5 | 26 | 407.55 | 580 | 50100 | 205° C. | 46.3% |
| 6 | 33 | 422.52 | 570 | 48900 | 179° C. | 75.3% |
| 7 | 37 | 437.58 | 582 | 51400 | 211° C. | 60.2% |
| 8 | 46 | 409.52 | 580 | 50900 | 196° C. | 42.9% |
| 1 | 47 | 379.5 | 580 | 52300 | 201° C. | 33.6% |
| 2 | 49 | 407.55 | 580 | 48700 | 243° C. | 65.1% |
| 9 | 63 | 411.5 | 572 | 47300 | 226° C. | 78.9% |
| 3 | STRUCTURAL FORMULA (1) | 379.5 | 580 | 49700 | 213° C. | 72.5% |

Subsequently, synthesis examples of the metal chelate colorants represented by the general formulae (2) to (6) will be shown.

Synthesis Example 10

Synthesis of Metal Chelate Colorant (3)-5

The exemplified compound 47 (24.3 g, 0.06402 mol) and the metal-containing compound VI-7 (29.5 g, 0.03201 mol) were added into 100 mL of methanol, and refluxed for 2 hours with stirring. After cooling the reaction solution, the solvent was distilled off by concentration under reduced pressure. Diisopropylether was added to the resulting reaction mixture, and precipitated crystal was filtrated to yield 46.3 g of a metal chelate colorant (3)-5 (yield 86.0%). In an acetone solution, % max of this colorant was 620 nm, and its molar extinction coefficient (ϵ) was 61700.

Synthesis Example 11

Synthesis of Metal Chelate Colorant (5)-5

The reaction and the purification were performed by the same formulation as in the synthesis example 7, except for using 26.1 g (0.03201 mol) of the exemplified compound 49 in place of the exemplified compound 47 in the synthesis example 7 to yield 37.1 g of a metal chelate colorant (5)-5 (yield 66.7%).

In an acetone solution, λmax of this colorant was 621 nm, and its molar extinction coefficient (ϵ) was 58400.

Synthesis Example 12

Synthesis of Metal Chelate Colorant (6)-1

The structural formula (1) (24.3 g, 0.06402 mol) and the metal-containing compound VI-1 (17.3 g, 0.03201 mol) were added into 100 mL of methanol, and refluxed for 2 hours with stirring. After cooling the reaction solution, precipitated solid was filtrated to yield 40.5 g of crude crystal. This crude crystal was recrystallized from methanol to yield 3.45 g of a metal chelate colorant (yield 82.9%). In an acetone solution, λmax of this colorant was 620 nm, and its molar extinction coefficient (ϵ) was 60300.

Synthesis Example 13

Synthesis of Metal Chelate Colorant (6)-2

The reaction and the purification were performed by the same formulation as in the synthesis example 9, except for using 29.5 g (0.03201 mol) of VI-7 in place of the metal-containing compound VI-1 in the synthesis example 12 to yield 42.6 g of a metal chelate colorant (6)-2 (yield 79.1%).

In an acetone solution, λmax of this colorant was 621 nm, and its molar extinction coefficient (ϵ) was 62100.

The other metal chelate colorants were synthesized by the same method.

The synthesized compounds are shown in Table 3.

TABLE 3

| SYNTHESIS EXAMPLE | METAL CHELATE COLORANT | COLORANT NO. | MOLECULAR WEIGHT | COMPOUND VI | MOLECULAR WEIGHT | MOLECULAR WEIGHT OF METAL CHELATE COLORANT | λMAX/ε | YIELD |
|---|---|---|---|---|---|---|---|---|
| 14 | (2)-1 | 3 | 435.6 | VI-1 | 541.3 | 1412.5 | 619/57200 | 53.6% |
| 15 | (2)-2 | 3 | 435.6 | VI-2 | 546.2 | 1417.4 | 604/53200 | 65.4% |
| 16 | (2)-9 | 26 | 407.6 | VI-9 | 921.9 | 1737.0 | 620/61100 | 72.8% |
| 17 | (3)-1 | 63 | 411.5 | VI-1 | 541.3 | 1364.3 | 616/56900 | 49.1% |
| 10 | (3)-5 | 47 | 379.5 | VI-7 | 921.9 | 1680.9 | 620/61700 | 86.0% |
| 18 | (4)-1 | 33 | 422.5 | VI-1 | 541.3 | 1386.3 | 615/56400 | 66.1% |
| 19 | (4)-5 | 46 | 409.5 | VI-7 | 921.9 | 1740.9 | 620/60900 | 71.2% |
| 20 | (5)-1 | 37 | 437.6 | VI-1 | 541.3 | 1416.5 | 620/59700 | 50.2% |
| 11 | (5)-5 | 49 | 407.6 | VI-7 | 921.9 | 1737.0 | 621/58400 | 66.7% |
| 12 | (6)-1 | STRUCTURAL FORMULA (1) | 379.5 | VI-1 | 541.3 | 1300.3 | 620/60300 | 82.9% |
| 13 | (6)-2 | STRUCTURAL FORMULA (1) | 379.5 | VI-7 | 921.9 | 1680.9 | 621/62100 | 79.1% |

Subsequently, the thermal transfer material (also referred to as a thermal transfer sheet colorant providing material), the image receiving material (also referred to as an image receiving sheet) and the thermal transfer recording method will be described below.

(Support)

A support used for the thermal transfer recording material of the invention is not particularly limited, and the same supports as those used for the conventional thermal transfer sheet can be used without any particular limitation. Specific examples of the preferable support include thin paper such as glassine paper, condenser paper and paraffin paper, stretched or unstretched film of plastics such as polyester with high heat resistance such as polyethylene terephthalate, polyphenylene sulfide, polyether ketone and polyether sulfone, and polypropylene, polycarbonate, cellulose acetate, polyethylene derivatives, polyvinyl chloride, polyvinylidene chloride, polystyrene, polyamide, polyimide, polymethylpentene and ionomers, and laminates thereof.

A thickness of this support can be appropriately selected so that strength, heat conductivity and heat resistance are adequate, and typically the thickness of about 1 to 100 μm is preferable. In the support as the above, when adhesiveness to a colorant providing layer (also referred to as a thermal transfer layer, an ink layer or dye layer) formed on the surface thereof is poor, it is preferable to give a primer treatment or a corona treatment onto the surface.

(Dye Layer)

In the present invention, as a thermally diffusible dye contained in a dye layer provided on one side of the support, reactive dye can be used in terms of obtaining good image stability.

In the invention, the reactive dye indicates the dye which forms the image by reacting a dye precursor contained in the dye layer with a dye fixing body contained in an image receiving layer by the thermal transfer, as described above. Specifically, it is possible to use the reactive dyes known publicly including aforementioned ones, but in the invention, in terms of particularly excellent image stability, it is preferable to use a combination of an post-chelate dye (dye capable of being chelated) and a metal source.

The post-chelate dye is not particularly limited as long as it is thermally transferable, and publicly known various compounds can be appropriately selected and used. Specifically, it is possible to use cyan dyes, magenta dyes, yellow dyes and the like described in, for example, JP SHO 59-78893 A, 59-109349 A, Tokugan HEI 2-213303, 2-214719, 2 -203742, JP HEI 10-258580 A, JP 2000-1057 A and Tokugan 2001-032618.

Particularly preferable post-chelate dyes used for the invention are shown below. First, concerning yellow colorants, the following exemplified compounds No. (1)-1 to (1)-32 can be exemplified.

(Exemplified Compound)
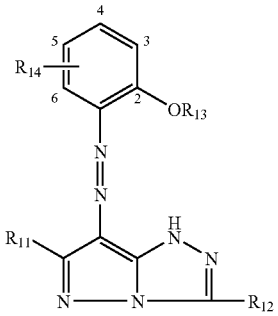
| Compound No. | $R_{11}$ | $R_{12}$ | $R_{13}$ | $R_{14}$ |
|---|---|---|---|---|
| (1)-1 | —$CH_3$ | —$C_4H_9$ | —$CH_3$ | — |
| (1)-2 | —$C_3H_7$(i) | 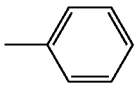 | —$CH_3$ | — |
| (1)-3 | —$C_3H_7$(i) | —$C_2H_5$ | —$CH_3$ | — |
| (1)-4 | —$CH_3$ | —$C_2H_5$ | —$CH_3$ | — |
| (1)-5 | —$C_3H_7$(i) | 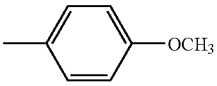 | —$CH_3$ | 4-Cl |
| (1)-6 | —$C_3H_7$(i) | —$C_2H_5$ | —$CH_3$ | 4-$CO_2CH_3$ |
| (1)-7 | —$C_3H_7$(i) | —$C_4H_9$ | —$CH_3$ | 5-$CO_2CH_3$ |
| (1)-8 | —$C_4H_9$(t) | —$C_4H_9$ | —$CH_3$ | — |
| (1)-9 | —$C_3H_7$(i) | 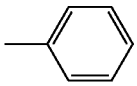 | —$C_3H_7$(i) | — |
| (1)-10 | —$C_3H_7$(i) | 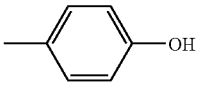 | —$CH_3$ | — |
| (1)-11 | —$C_3H_7$(i) | —$C_3H_7$ | —$CH_3$ | 5-Cl |
| (1)-12 | —$C_3H_7$(i) | 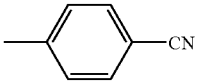 | —$CH_3$ | — |
| (1)-13 | —$C_4H_9$(t) | 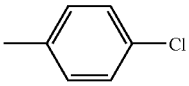 | —$CH_3$ | — |
| (1)-14 | —$SCH_3$ | 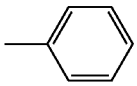 | —$CH_3$ | — |
| (1)-15 | 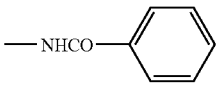 | —$C_2H_5$ | —$CH_3$ | — |
| (1)-16 | 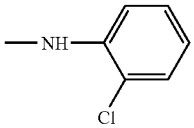 | —$C_2H_5$ | —$CH_3$ | — |
| (1)-17 | —$OCH_3$ | —$C_4H_9$ | —$CH_3$ | — |
| (1)-18 | —$C_4H_9$(t) | —$C_4H_9$ | —$CH_3$ | 4-$CO_2H$ |

-continued
| | | | | |
|---|---|---|---|---|
| (1)-19 | —$C_3H_7$(i) | 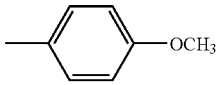 | —$CH_3$ | — |
| (1)-20 | —$C_3H_7$(i) | 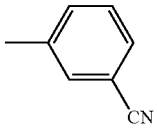 | —$CH_3$ | — |
| (1)-24 | —$C_3H_7$(i) | —$C_2H_5$ | —$CH_3$ | 5-Cl |
| (1)-25 | —$C_4H_9$(t) | —$C_4H_9$ | —$CH_3$ | 5-Cl |
| (1)-26 | —$C_4H_9$(t) | —$C_2H_5$ | —$CH_3$ | 5-Cl |
| (1)-27 | —$C_4H_9$(t) | 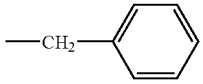 | —$CH_3$ | 5-Cl |
| (1)-28 | —$C_4H_9$(t) | 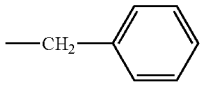 | —$CH_3$ | — |
| (1)-29 | —$C_4H_9$(t) | —$CHC_4H_9$ \| $C_2H_5$ | —$CH_3$ | 5-Cl |
| (1)-30 | —$C_4H_9$(t) | —$C_6H_{13}$ | —$CH_3$ | 5-Cl |
| (1)-31 | —$C_4H_9$(t) | —$CH_3$ | —$CH_3$ | 5-Cl |
| (1)-32 | —$C_4H_9$(t) | —$CH_3$ | —$CH_3$ | — |
(1)-21
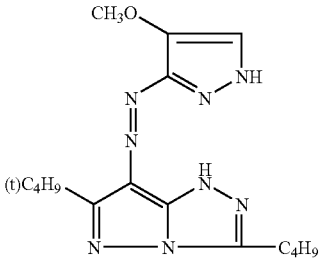
(1)-22
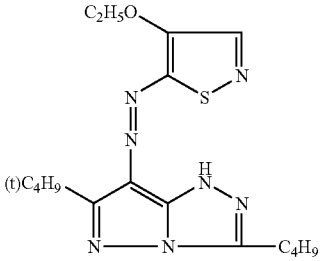
(1)-23
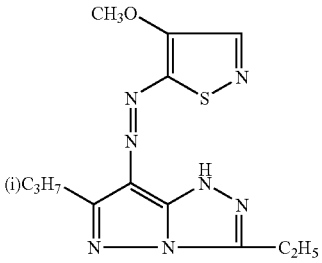

Concerning magenta colorants, the following exemplified compounds No. (2)-1 to (2)-38 can be exemplified.
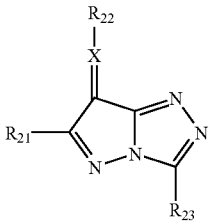
Substituent $R_{21}$
(1) $CH_3$
(2) $C_4H_9(t)$
(3)
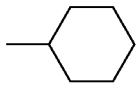
(4)
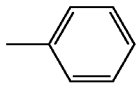
(5)
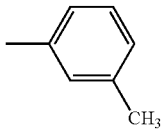
(6)
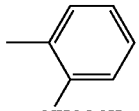
(7)
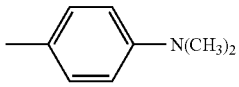
(8)
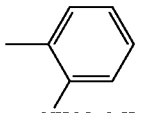
(9)
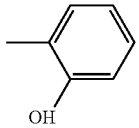
(10)
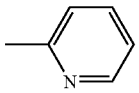
(11)
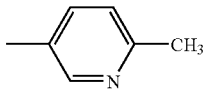
(12)
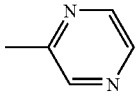
-continued
(13)
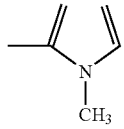
(14)
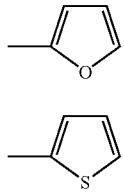
(15)
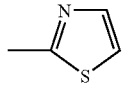
(16)
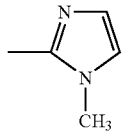
(17)
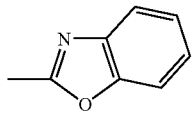
(18)
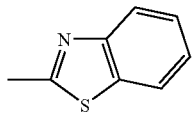
(19)
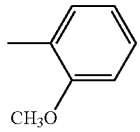
(20)
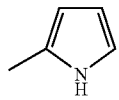
Substituent $R_{22}$
(1)
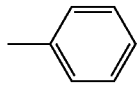
(2)
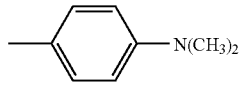
(3)
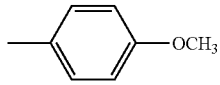

-continued
(4)
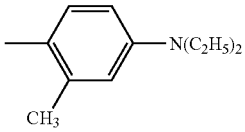
(5)
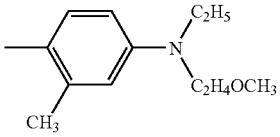
(6)
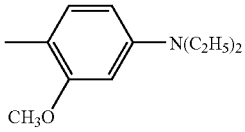
(7)
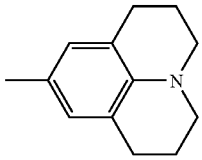
(8)
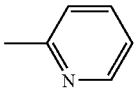
(9)
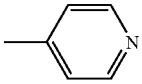
(10)
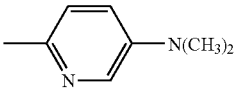
(11)
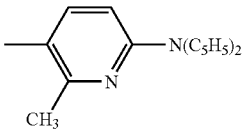
(12)
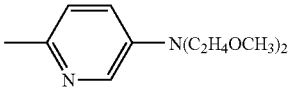
(13)
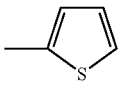
(14)
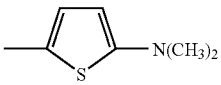
(15)
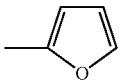
(16)
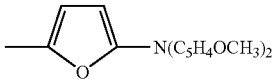
-continued
(17)
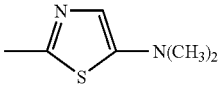
(18)
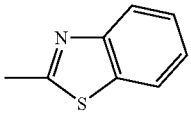
(19)
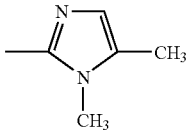
(20)
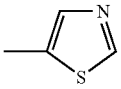
(21)
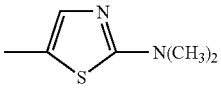
(22)
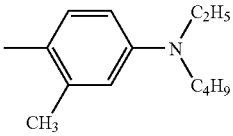
(23)
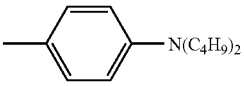
(24)
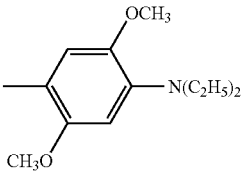
Substituent $R_{23}$
(1)
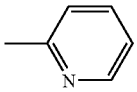
(2)
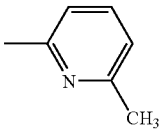
(3)
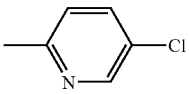
(4)
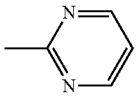

-continued (5)

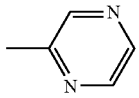

(6)

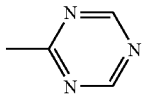

(7)

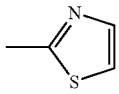

(8)

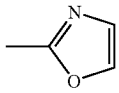

(9)

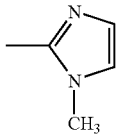

(10)

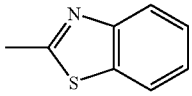

(11)

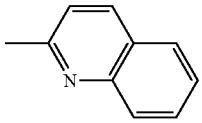

(12)

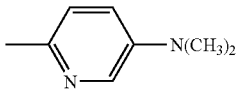

(13)

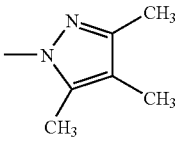

(14)

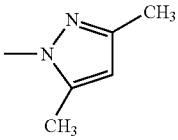

(15)

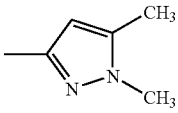

(16)

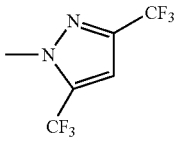

| COLORANT | $R_{21}$ | $R_{22}$ | $R_{23}$ | X |
|---|---|---|---|---|
| (2)-1 | (1) | (2) | (15) | N |
| (2)-2 | (1) | (6) | (9) | N |
| (2)-3 | (1) | (6) | (10) | N |
| (2)-4 | (1) | (11) | (7) | N |
| (2)-5 | (1) | (11) | (8) | N |
| (2)-6 | (1) | (17) | (8) | CH |
| (2)-7 | (1) | (20) | (6) | CH |
| (2)-8 | (1) | (21) | (7) | CH |
| (2)-9 | (2) | (4) | (3) | N |
| (2)-10 | (2) | (4) | (5) | N |
| (2)-11 | (2) | (4) | (6) | N |
| (2)-12 | (2) | (8) | (3) | CH |
| (2)-13 | (2) | (10) | (4) | CH |
| (2)-14 | (2) | (11) | (1) | N |
| (2)-15 | (2) | (13) | (15) | CH |
| (2)-16 | (2) | (14) | (1) | CH |
| (2)-17 | (2) | (14) | (4) | N |
| (2)-18 | (2) | (19) | (5) | CH |
| (2)-19 | (3) | (5) | (2) | N |
| (2)-20 | (3) | (16) | (9) | CH |
| (2)-21 | (3) | (18) | (10) | CH |
| (2)-22 | (4) | (3) | (2) | CH |
| (2)-23 | (4) | (3) | (14) | N |
| (2)-24 | (4) | (7) | (13) | N |
| (2)-25 | (4) | (10) | (11) | N |
| (2)-26 | (4) | (13) | (12) | CH |
| (2)-27 | (4) | (15) | (11) | CH |
| (2)-28 | (5) | (9) | (14) | CH |
| (2)-29 | (5) | (12) | (13) | CH |
| (2)-30 | (5) | (21) | (12) | N |
| (2)-31 | (10) | (2) | (15) | N |
| (2)-32 | (16) | (13) | (15) | CH |
| (2)-33 | (17) | (18) | (15) | N |
| (2)-34 | (18) | (21) | (15) | CH |
| (2)-35 | H | (7) | (16) | CH |
| (2)-36 | H | (16) | (16) | N |
| (2)-37 | (2) | (4) | (5) | CH |
| (2)-38 | (2) | (22) | (5) | CH |

Concerning cyan colorants, the colorants represented by the aforementioned general formulae (II) to (V) and the structural formula (1) are exemplified.

An addition amount of the post-chelate dye used for the invention is typically preferably 0.1 to 20 g, and more preferably 0.2 to 5 g based on 1 $m^2$ of a dye solid content.

Furthermore, in the invention, a metal chelate colorant can be used by adding in the dye layer. The metal chelate colorant will be described in detail later. In this case, the addition amount of the post-chelate dye used for the invention is not particularly limited, and is typically preferably 0.1 to 20 g, and more preferably 0.2 to 5 g based on 1 $m^2$ of the dye solid content.

The metal chelate colorant used for the thermal transfer recording material of the invention is not particularly limited, can include, for example, the compound represented by at least one of the following general formulae (2) to (6), and is preferably the compound of the structure shown in JP 2004-74617 A.

In particular, concerning the cyan colorant, it is preferable to use the compounds of the invention.

General formula (2)

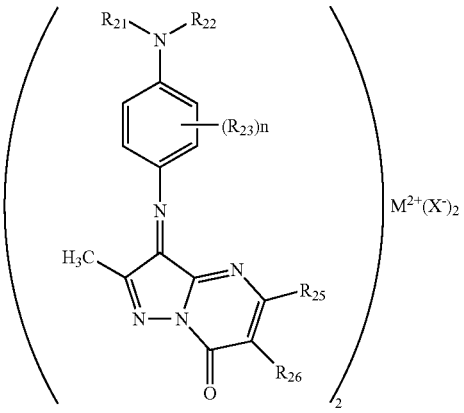

General formula (3)

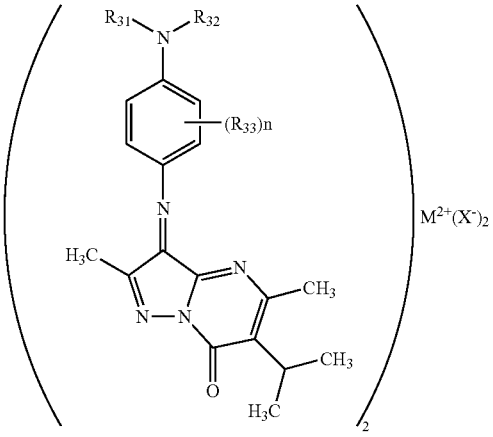

General formula (4)

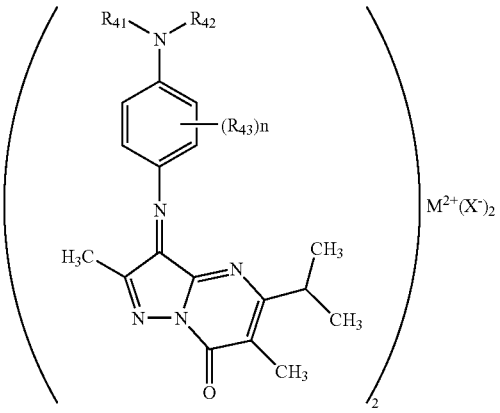

-continued

General formula (5)

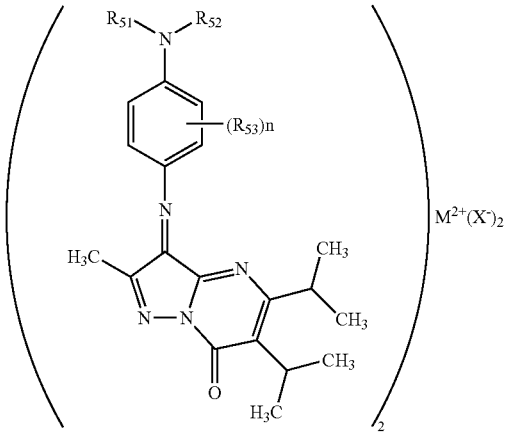

General formula (6)

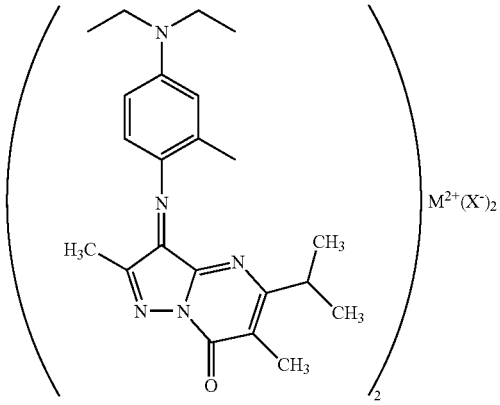

In the general formulae (2) to (6), substituents $R_{31}$, $R_{32}$, $R_{33}$, $R_{41}$, $R_{42}$, $R_{43}$, $R_{51}$, $R_{52}$ and $R_{53}$ are the same as those defined in the aforementioned general formula (II) and the general formulae (III) to (V).

$M^{2+}$ represents a bivalent metal ion, and among them, nickel and zinc are preferable in terms of the color of the metal-containing compound per se and the color tone of the metal chelate colorant. X represents a compound represented by the general formula (VII) described later, which can form a complex with the bivalent metal ion.

Specific examples of the metal chelate colorants represented by the general formulae (2) to (6) will be shown below, but the present invention is not limited thereto.

TABLE 4

| METAL CHELETE COLORANT | COLORANT NO. | METAL SOURCE |
|---|---|---|
| (2)-1 | 3 | VI-1 |
| (2)-2 | 3 | VI-2 |
| (2)-3 | 7 | VI-5 |
| (2)-4 | 7 | VI-6 |
| (2)-5 | 14 | VI-7 |
| (2)-6 | 14 | VI-8 |
| (2)-7 | 19 | VI-3 |
| (2)-8 | 19 | VI-4 |
| (2)-9 | 26 | VI-9 |
| (2)-10 | 26 | VI-10 |
| (3)-1 | 63 | VI-1 |

TABLE 4-continued

| METAL CHELETE COLORANT | COLORANT NO. | METAL SOURCE |
|---|---|---|
| (3)-2 | 63 | VI-5 |
| (3)-3 | 47 | VI-1 |
| (3)-4 | 47 | VI-5 |
| (3)-5 | 47 | VI-7 |
| (4)-1 | 33 | VI-1 |
| (4)-2 | 33 | VI-5 |
| (4)-3 | 46 | VI-1 |
| (4)-4 | 46 | VI-5 |
| (4)-5 | 46 | VI-7 |
| (5)-1 | 37 | VI-1 |
| (5)-2 | 37 | VI-5 |
| (5)-3 | 49 | VI-1 |
| (5)-4 | 49 | VI-5 |
| (5)-5 | 49 | VI-7 |
| (6)-1 | STRUCTURAL FORMULA (1) | VI-1 |
| (6)-2 | STRUCTURAL FORMULA (1) | VI-7 |

A binder resin used for the dye layer includes water-soluble polymers such as cellulose, polyacrylate, polyvinyl alcohol and polyvinyl pyrrolidone type polymers, and organic solvent-soluble polymers such as acrylic resin, methacrylic resin, polystyrene, polycarbonate, polysulfone, polyether sulfone, polyvinyl butyral, polyvinyl acetal, ethylcellulose and nitrocellulose. Among these resins, polyvinyl butyral, polyvinyl acetal and cellulose type resins which are excellent in storage stability are preferable. When the polymer soluble in the organic solvent is used, the polymer may be used not only by dissolving in one or two or more organic solvents but also by making a latex dispersion. The amount of the binder resin to be used is preferably 0.1 to 50 g based on 1 $m^2$ of the support.

In order to enhance release property from a colorant image-receiving layer (also referred to as a dye image-receiving layer), a release agent may be added or a distinct release later (referred to as a non-transferable release layer) containing the release agent may be provided in the dye layer. As the release agent, it is possible to use reaction curable silicone, a phosphate ester type surfactant and a fluorine compound. The amount of the release agent to be used is preferably 0.5 to 40% by mass based on the solid content of the layer in which the release agent is contained. When the release layer is provided, it is possible to use the same binder as that used in the above dye layer.

It is also preferable to provide a back layer for imparting the heat resistance, on the side of the support, opposite to the side on which the dye layer is provided. (Back layer: also referred to as BC layer, a back coat layer, a back coating layer, a sticking prevention layer)

(Protection Layer)

In the thermal transfer recording of the present invention, a transparent protection layer formed by the thermal transfer can be provided on the surface of a recording medium after the dye transfer.

The protection layer used for the invention can be also provided on the same phase as that of the above dye layer in a so-called phase sequential. When the protection layer is used alone as a protection layer transfer sheet, the same support and back layer as those described above can be used.

In the invention, it is preferable to provide a thermally transferable protection layer on the support via the non-transferable release layer.

The non-transferable release layer may be provided via or not via a primer layer.

It is preferable that the non-transferable release layer (1) contains 30 to 80% by mass inorganic fine particles with an average particle size of 40 nm or less with the resin binder, (2) contains a copolymer of alkyl vinyl ether and maleic acid anhydrate, a derivative thereof or a mixture thereof at 20% by mass or more as a total, or (3) contains an ionomer at 20% by mass or more, for the purpose of making an adhesive power between the support and the non-transferable release layer always sufficiently higher than an adhesive power between the non-transferable release layer and the thermally transferable protection layer (protection transfer layer), and making the adhesive power between the non-transferable release layer and the thermally transferable protection layer before heating higher than that after heating. Other additives may be contained in the non-transferable release layer if necessary.

As the inorganic fine particles, for example, it is possible to use silica fine particles of silica anhydrate and colloidal silica, and metal oxide such as zinc oxide and zinc antimonate. The particle size of the inorganic fine particles is preferably 40 nm or less. When the particle size is more than 40 nm, it is not preferable because the surface of the thermally transferable protection layer becomes highly concavoconvex due to the concavoconvex surface of the release layer and consequently the transparency of the protection layer is reduced.

The resin binder mixed with the inorganic particles is not particularly limited, and any resins capable of being mixed can be used. For example, polyvinyl alcohol resins (PVA) with various saponification degrees; polyvinyl acetal resins; polyvinyl butyral resins; acrylic type resins; polyamide type resins; cellulose type resins such as cellulose acetate, alkyl cellulose, carboxymethylcellulose and hydroxyalkylcellulose; polyvinyl pyrrolidone resins are included.

A combination ratio (inorganic fine particles/other combined ingredients) of the inorganic fine particles with the other combined ingredients whose main body is the resin binder is preferably in the range of 30/70 or more and 80/20 or less at a weight ratio. When the combination ratio is less than 30/70, the effect of the inorganic fine particles becomes insufficient whereas when it is more than 80/20, the release layer does not form a complete film, and the support and the thermally transferable protection layer are directly contacted in part.

As the copolymer of alkyl vinyl ether and maleic acid anhydrate or the derivative thereof described in the above (2), it is possible to use, for example, one where the alkyl group in an alkyl vinyl ether moiety is methyl or ethyl, or one where a maleic acid anhydrate moiety is partially or completely half-esterified with alcohol (e.g., methanol, ethanol, propanol, isopropanol, butanol, isobutanol).

The release layer may be formed only from the copolymer of alkyl vinyl ether and maleic acid anhydrate, the derivative thereof or the mixture thereof, but the other resin or fine particles may be further added for the purpose of regulating a releasing power between the release layer and the protection layer. In that case, it is preferable to contain the copolymer of alkyl vinyl ether and maleic acid anhydrate, the derivative thereof or the mixture thereof at 20% by mass or more. When the amount to be contained is less than 20% by mass, the effect of the copolymer of alkyl vinyl ether and maleic acid anhydrate or the derivative thereof becomes insufficient.

A resin or fine particles combined in the copolymer of alkyl vinyl ether and maleic acid anhydrate or the derivative thereof are not particularly limited as long as they can be mixed and have high film transparency upon the film formation, and any materials can be used. For example, the aforementioned inorganic fine particles and the resin binder capable of being mixed with the inorganic fine particles are preferably used.

As the ionomer described in the above (3), for example, Surlyn A (supplied from DuPont) and Chemipearl S series (supplied from Mitsui Petroleum Chemical Ind., Ltd.) can be used. The aforementioned inorganic fine particles, the resin binder capable of being mixed with the inorganic fine particles, or other resins and fine particles can be further added to the ionomer.

To form the non-transferable release layer, a coating solution containing any ingredient of the above (1) to (3) at a given combination percentage is prepared, such a coating solution is applied on the support by a publicly known method such as gravure coating and gravure reverse coating, and an applied layer is dried. The thickness of the non-transferable release layer is typically about 0.1 to 2 μm after drying.

The thermally transferable protection layer laminated on the support via or not via the non-transferable release layer may take a multilayer structure or a single layer structure. When it takes the multilayer structure, an adhesive layer arranged on an outmost surface of the thermally transferable protection layer for enhancing the adhesiveness between the thermally transferable protection layer and the image receiving surface of the photographically printed matter, an auxiliary protection layer, a layer (e.g., anti-counterfeit layer, hologram layer) for adding a function other than the original function of the protection layer may be provided in addition to the major protection layer which is a main body for imparting various durability to the image. An order of the main protection layer and the other layers is optional, but typically, the other layers are arranged between the adhesive layer and the main protection layer so that the main protection layer is the outmost surface of the image receiving material or the image receiving sheet after the transfer.

A main protection layer which is one layer of the thermal transferable protection layer with multilayer structure or the thermal transferable protection layer with single layer structure can be formed by various resins conventionally known as the resins for forming the protection layer. As the resins for forming the protection layer, for example, it is possible to exemplify polyester resins, polystyrene resins, acrylic resins, polyurethane resins, acrylurethane resins, silicone-modified resins thereof, mixtures thereof, ionizing radiation curable resins, ultraviolet ray blocking resins and the like.

The protection layer containing the ionizing radiation curable resin is particularly excellent in plasticizer resistance and abrasion resistance. As the ionizing radiation curable resin, those known publicly can be used. For example, it is possible to use one obtained by crosslinking and curing a radically polymerizable polymer or oligomer by the irradiation of the ionizing radiation, and if necessary, adding a photopolymerizable initiator and polymerizing and crosslinking by electron ray or ultraviolet ray.

The protection layer containing the ultraviolet ray blocking resin is primarily intended to impart the light resistance to a photographically printed matter. As the ultraviolet ray blocking resin, it is possible to use the resin obtained by reacting and binding a reactive ultraviolet ray absorbing agent to thermoplastic resin or the above ionizing radiation curable resin. More specifically, it is possible to exemplify one obtained by introducing a reactive group such as addition polymerizable double bond (e.g., vinyl, acryloyl, methacryloyl groups), alcoholic hydroxyl, amino, carboxyl, epoxy and isocyanate groups into a non-reactive organic ultraviolet ray absorbing agent known conventionally and publicly such as salicylate, benzophenone, benzotriazole, substituted acrylonitrile, nickel chelated, hindered amine types.

The thickness of the thermally transferable protection layer having the single layer structure as the above or a main protection layer provided in the thermally transferable protection layer having the multilayer structure is typically about 0.5 to 10 μm, depending on a type of the resin for forming the protection layer.

On the outmost surface of the thermally transferable protection layer, the adhesive layer may be formed. The adhesive layer can be formed from the resin with good adhesiveness upon heating, such as acrylic resins, vinyl acetate resins, copolymer resin of vinyl chloride and vinyl acetate, polyester type resins and polyamide type resins. The aforementioned ionizing radiation curable resin and the ultraviolet ray blocking resin may be mixed if necessary in addition to the above resins. The thickness of the adhesive layer is typically 0.1 to 5 μm.

To form the thermally transferable protection layer on the non-transferable release layer or the support, for example, a coating solution for the protection layer containing the resin for forming the protection layer, a coating solution for the adhesive layer containing the thermally adhesive resin and the other coating solution for forming the layer added as needed are previously prepared, they are applied in a given order on the non-transferable release layer or the support, and dried. Each coating solution may be applied by a conventionally and publicly known method. An appropriate primer layer may be provided between respective layers.

Furthermore, when a post-chelate dye is used as a dye precursor in the aforementioned thermal transferable protection layer, a dye fixing body (metal source) described later can be also contained for the purpose of enhancing chelating property after the dye transfer.

The amount of the metal source to be added is preferably 0.01 to 1%, and in particular preferably 0.05 to 0.5% by mass based on the total solid content of the layer in which the metal source is contained. The amount to be added can be varied depending on the intended use, and thus is not particularly limited.

(Non-transferable Resin Layer)

In the thermal transfer recording of the present invention, a reheating treatment can be performed by opposing the transferred surface after the dye transfer to the surface of the non-transferable resin layer in the recording medium, and giving the heat from the side opposite to the non-transferable resin layer.

The non-transferable resin layer can be also provided on the same phase as that of the above dye layer in a so-called phase sequential. When the non-transferable resin layer is used alone as a sheet, the same support and back layer as those described above can be used.

The same binder resin as that used in the dye layer can be used for the non-transferable resin layer.

When the non-transferable resin layer and the dye layer are provided in the phase sequential, it is preferable to contain fine particles in the resin layer. This is carried out for the purpose of preventing a so-called kick back phenomenon that the dye slightly migrates into the back layer when stored in a roll state after coating and the dye which has migrated into the back layer is retransferred to the non-transferable resin layer when made into a small package as a product form. When the kick back occurs, the retransferred dye into the resin layer colors an image receiving surface upon photographic printing, and remarkably impairs an image quality. As the fine particles, it is possible to use resin fine particles of acrylic resins, fluorine resins, polyethylene resins and polystyrene resins or wax particles in addition to inorganic fine particles of silica, alumina and calcium carbonate. A particle size of these fine particles is preferably 0.1 to 50 μm. When the particle size is less than 0.1 μm, the fine particles have no effect on the kick back because the resin layer surface is not significantly concavoconvex. When it is more than 50 μm, the fine particles spoils an image surface after the photographic printing and impairs the image quality. The preferable amount of the above fine particles to be added is 1 to 50%, and particularly preferably 5 to 30% by mass based on the total solid content of the resin layer. When the amount is less than 1% by mass, the fine particles have no effect on the kick back because the resin layer surface is not significantly concavoconvex. When it is more than 50% by mass, the fine particles spoils the image surface after the photographic printing and impairs the image quality.

In the thermal transfer recording material or the thermal transfer sheet of the invention, for the purpose of completing the reaction of the reactive dye, the dye fixing body is contained in the resin layer or a resin layer containing the dye fixing body is provided. When the resin layer containing the dye fixing body is provided, the same binder resin as that used in the dye layer can be used. When the post-chelate dye is used as the dye precursor, it is preferable to contain the metal source as the dye fixing body.

As the metal source used for the invention, compounds represented by the general formula (VI) are preferable.

$$[M(Q_1)_a(Q_2)_b(Q_3)_c]^{p+}(Y^-)_p \qquad \text{General formula (VI)}$$

In the formula, M represents a metal ion, preferably $Ni^{2+}$, $Cu^{2+}$, $Cr^{2+}$, $Co^{2+}$ or $Zn^{2+}$.

$Q_1$, $Q_2$ and $Q_3$ each represent coordination compounds capable of forming a coordinate bond with the metal ion represented by M, and may be the same or different. These coordination compounds can be selected from the coordination compounds described in "Chelate Science (5)" (Nanzando).

Y represents an organic anion group, and specifically includes tetraphenylborate anion and alkylbenzenesulfonate anion.

Signs, a represents 1, 2 or 3, b represents 1, 2 or 0, and c represents 1 or 0. These are determined depending on whether the complex is tetradentate or hexadentate, or determined by the number of ligands of $Q_1$, $Q_2$ and $Q_3$.

The sign, p represents 1 or 2. The p=0 means that the coordination compound represented by Q is an anionic compound and that the anionic compound represented by Q and the metal cation represented by M are electrically neutralized. As the anionic compound, compounds represented by the following general formula (VII) are preferable.

$$OC(R_5)=CH(R_7)COR_6 \qquad \text{General formula (VII)}$$

In the formula, $R_5$ and $R_6$ may be the same or different, and represent alkyl or aryl. $R_7$ represents alkyl, alkoxy, alkoxycarbonyl, a halogen atom or a hydrogen atom.

The amount of the metal source to be added is preferably 0.01 to 1%, and in particular preferably 0.05 to 0.5% by mass based on the total solid content of the resin layer (when provided as the dye fixing body-containing layer, it is included). When the amount is less than 0.1% by mass, the effect of the addition is insufficient whereas when it is more than 1% by mass, the aforementioned kick back occurs more remarkably.

In order to enhance release property between the image receiving layer and the non-transferable resin layer, a release agent may be added or a distinct release later containing the release agent may be provided. As the release agent, it is possible to use reaction curable silicone, a phosphate ester type surfactant and a fluorine compound. The amount of the release agent to be used is preferably 0.5 to 40% by mass based on the solid content of the layer in which the release agent is contained. When the release layer is provided, it is possible to use the same binder as that used in the above dye layer.

Specific structures of the compounds represented by the general formula (VII) and the corresponding metal sources (VI) will be shown below.

(VI-1)

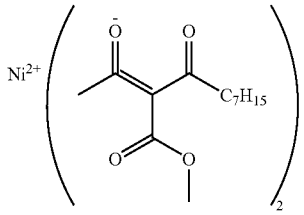

(VI-2)

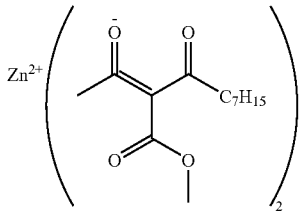

(VI-3)

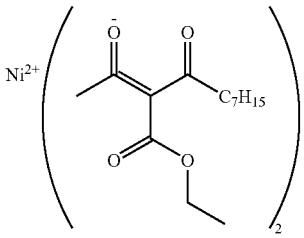

(VI-4)

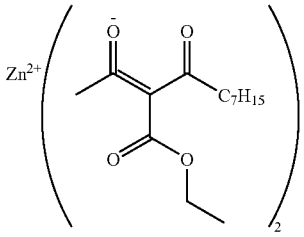

(VI-5)

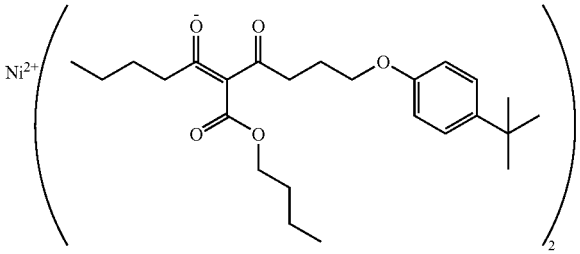

-continued
(VI-6)
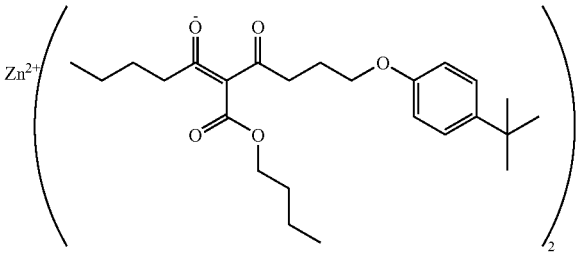
$C_{13}H_{22}O_4$
Mol. Wt.: 242.31
(VI-7)
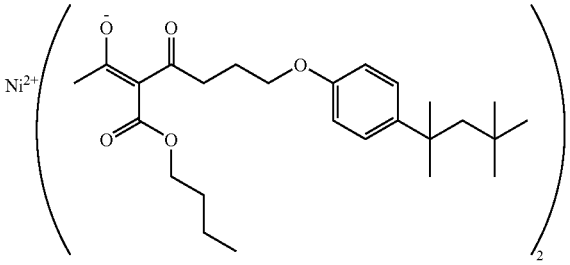
$C_{14}H_{24}O_4$
Mol. Wt.: 256.34
(VI-8)
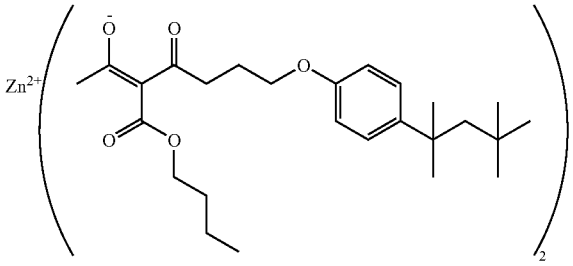
$C_{12}H_{22}O_4$
Mol. Wt.: 230.30
(VI-9)
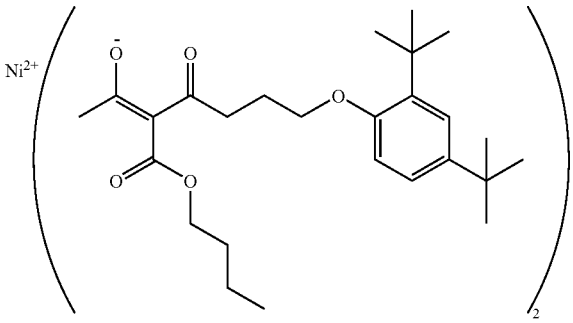
$C_{16}H_{28}O_4$
Mol. Wt.: 284.39
(VI-10)
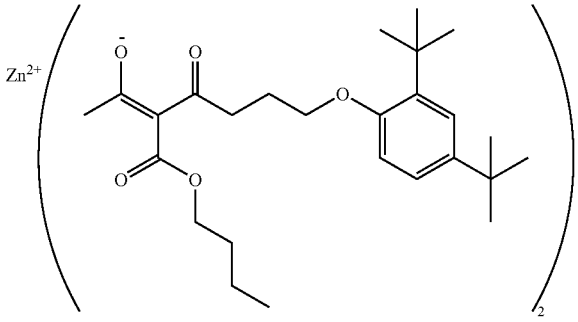
$C_{25}H_{38}O_5$
Mol. Wt.: 418.57
-continued
(VII-1)
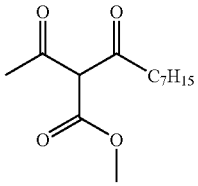
(VII-2)
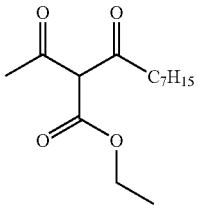
(VII-3)
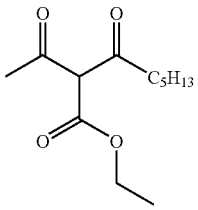
(VII-4)
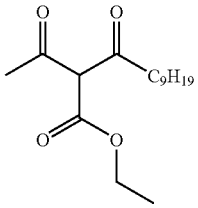
(VII-5)
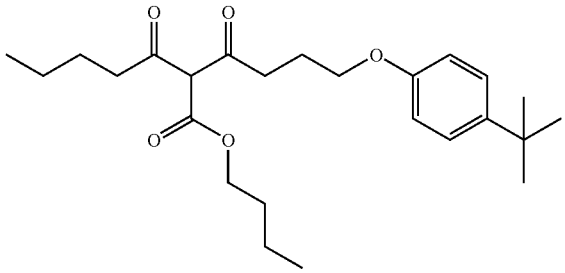

-continued (VII-6)

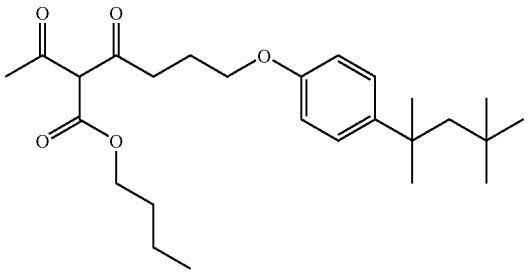

$C_{26}H_{40}O_5$
Mol. Wt.: 432.59

(VII-7)

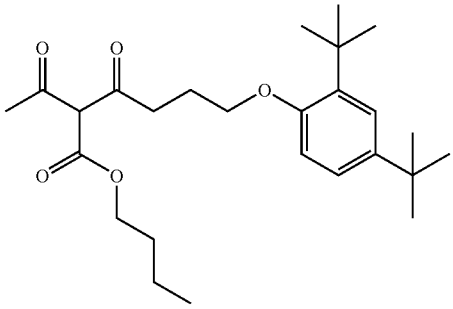

$C_{26}H_{40}O_5$
Mol. Wt.: 432.59

(VII-8)

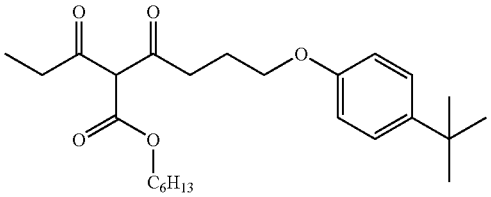

$C_{25}H_{38}O_5$
Mol. Wt.: 418.57

(VII-9)

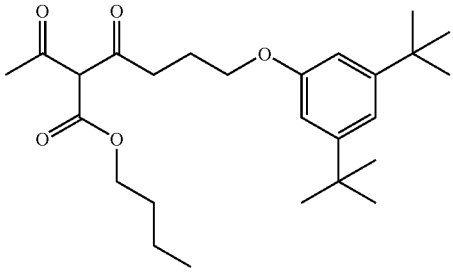

$C_{26}H_{40}O_5$
Mol. Wt.: 432.59

(VII-10)

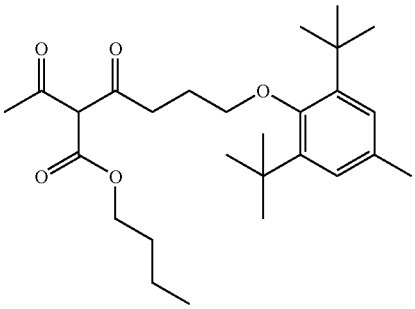

$C_{27}H_{42}O_5$
Mol. Wt.: 446.62

TABLE 5

| GENERAL FORMULA (VII) | MOLECULAR WEIGHT | Ni COMPLEX | MOLECULAR WEIGHT | Zn COMPLEX | MOLECULAR WEIGHT |
|---|---|---|---|---|---|
| VII-1 | 242.31 | VI-1 | 927.87 | VI-2 | 932.73 |
| VII-2 | 256.34 | VI-3 | 959.87 | VI-4 | 964.73 |
| VII-3 | 230.3 | | | | |
| VII-4 | 284.39 | | | | |
| VII-5 | 418.57 | VI-5 | 895.79 | VI-6 | 900.65 |
| VII-6 | 432.59 | VI-7 | 919.81 | VI-8 | 924.67 |
| VII-7 | 432.59 | VI-9 | 929.77 | VI-10 | 934.63 |
| VII-8 | 418.57 | | | | |
| VII-9 | 432.59 | | | | |
| VII-10 | 446.62 | | | | |

(Intermediate Layer of Image Receiving Layer)

At least one or more intermediate layer may be provided between the image receiving layer of the image-receiving sheet and the support. The intermediate layer means all layers provided between the image-receiving layer and the support, such as an adhesive layer (primer layer), barrier layer, ultraviolet ray absorbing layer, foamed layer and antistatic layer, and any layer known publicly can be used as needed. Furthermore in order to opacify glaring feeling and unevenness of the support, the addition of the white pigment such as titanium oxide to the intermediate layer allows greater flexibility for support selection, and thus it is preferable. A content of the intermediate layer resin and the white pigment is preferably 30 to 300 parts by mass in terms of white pigment solid content based on 100 parts by mass of the solid content of the intermediate layer resin, and more preferably 100 to 300 parts by mass for enhancing opacifying property.

As the intermediate layer, a layer where thermoplastic resin, thermosetting resin or the thermoplastic resin having a functional group is cured by the use of various additives and the other technique can be used. Specifically, the resin obtained by curing polyvinyl alcohol, polyvinyl pyrrolidone, polyester, chlorinated polypropylene, modified polyolefin, urethane resin, acrylic resin, polycarbonate, an ionomer, or a prepolymer having monofunctional and/or multifunctional hydroxyl group with isocyanate and the like can be used.

(Image Receiving Layer)

The image receiving layer is composed of the dye fixing body and the binder resin, and if necessary various additives such as release agent on one side of the support. When the post-chelate dye is used as the dye precursor, the metal source is contained as the dye fixing body. As described above, when the metal chelate colorant is used as the dye, the metal source need not be added or may be appropriately added. The same metal source as that used in the aforementioned non-transferable resin layer can be used. Typically, the amount of the metal source to be added is preferably 10 to 60%, and more preferably 20 to 50% by mass based on the solid content of the image receiving layer.

As the binder resin, those known publicly can be used, and it is preferable to use those to which dye is easily dyed. Specifically, a simple substance or a mixture of polyolefin resin such as polypropylene, halogenated resin such as polyvinyl chloride and polyvinylidene chloride, vinyl type resin such as polyvinyl acetate and polyacrylate ester, polyester type resin such as polyethylene terephthalate and polybutylene terephthalate, polystyrene type resin, polyamide type resin, phenoxy resin, copolymers of olefin such as ethylene and propylene with the other vinyl type monomer, polyurethane, polycarbonate, acrylic resin, ionomer and a cellulose derivative can be used, and among them, the polyester type resin and the vinyl type resin are preferable.

It is preferable to add the release agent into the above image receiving layer in order to prevent thermal fusion with the dye layer. As the release agent, a phosphate ester type plasticizer, a fluorinated compound and silicone oil (including reaction curable silicone) and the like can be used, and among them, the silicone oil is preferable. As the silicone oil, various modified silicone oils including dimethyl silicone can be used. Specifically, amino modified silicone, epoxy modified silicone, alcohol modified silicone, vinyl modified silicone, urethane modified silicone and the like are used. These can be also used by blending them or polymerizing using various reactions. One or two or more release agents are used. The amount of the release agent to be added is preferably 0.5 to 30 parts by mass based on 100 parts by mass of the resin for forming the image receiving layer. When the amount to be added does not meet this range, the fusion of the thermal transfer sheet with the image receiving layer of the image receiving sheet occurs or photographic printing sensitivity is reduced in some cases. The release agent may be separately provided as the release layer on the image receiving layer without adding in the image receiving layer.

(Backside Resin Layer or Backside Layer of Image Receiving Sheet)

In a backside resin layer or a backside layer of the image receiving sheet, a compound intended to enhance mechanical feeding property, give antistatic property, impart writability and stamp pasting property may be contained. In order to obtain an antistatic function, a layer composed of conductive resin such as acrylic resin or a conductive filler may be formed. Furthermore a layer to which an antistatic agent such as fatty acid ester, sulfate ester, phosphate ester, amides, quaternary ammonium salts, betaines, amino acids and ethylene oxide adducts is added may be formed.

The amount of the antistatic agent to be used is varied depending on the type of the layer to which the antistatic agent is added and the type of the antistatic agent. In any case, it is preferable that a surface electrical resistance value of the image receiving sheet is 1013 ohms/cm$^2$ or less. When it is more than 1013 ohms/cm$^2$, the image receiving sheets stuck one another because of electrostatic cohesiveness and it causes paper supply trouble. Quantitatively, the amount to be used is preferably 0.01 to 3.0 g/m$^2$. When the amount of the antistatic agent to be used is less than 0.01 g/m$^2$, the antistatic effect is insufficient whereas when it is more than 3.0 g/m$^2$, the effect is not enhanced, it is uneconomical, and stickiness occurs in some cases.

A writable layer may be provided on the entire surface of the image receiving sheet or may be partially formed.

For the purpose of enhancing the feeding property, the addition of nylon resin particles and further higher fatty acid salts is also effective. The nylon resin particles include, for example, particles of nylon 12 and nylon 6. These nylon resin particles may be used alone or in combination of two or more types.

As the higher fatty acid salt, for example, calcium stearate, magnesium stearate, barium stearate, zinc stearate and the like can be used.

A forming procedure of the writable layer may be a conventionally and publicly known printing coating procedure. The thickness of the writable layer is about 0.5 to 20 g/m$^2$ when dried.

(Support of Image Receiving Sheet)

It is preferable that the support of the image receiving sheet has a role to retain the image receiving layer as well as mechanical strength to an extent that there is no trouble when handled under a heated condition because the heat is added upon the thermal transfer.

Materials of such a support are not particularly limited, and include, for example, condenser paper, glassine paper, parchment paper, or paper with high size degree, synthetic paper (polyolefin type, polystyrene type), quality paper, art paper, coated paper, cast-coated paper, wall paper, paper for lining, synthetic resin or emulsion-impregnated paper, synthetic rubber latex-impregnated paper, synthetic resin inner paper, plate paper, cellulose fiber paper, or films of polyester, polyacrylate, polycarbonate, polyurethane, polyimide, polyetherimide, cellulose derivative, polyethylene, ethylene-vinyl acetate copolymer, polypropylene, polystyrene, acryl, polyvinyl chloride, polyvinylidene chloride, polyvinyl alcohol, polyvinyl butyral, nylon, polyether ether ketone, polysulfone, polyethersulfone, tetrafluoroethylene, perfluoroalkylvinylether, polyvinyl fluoride, tetrafluoroethylene-ethylene, tetrafluoroethylene-hexafluoropropylene, polychlorotrifluoroethylene and polyvinylidene fluoride. White opaque films or foamed sheets obtained by adding a white pigment and a filler to these synthetic resins and making into the films or foaming can be used, and they are not particularly limited.

A laminate obtained by optionally combining the above support can be also used. Examples of the representative laminate include synthetic paper of cellulose fiber paper and synthetic paper or cellulose synthetic paper and plastic film. The thickness of these supports may be optional, and is typically about 10 to 300 μm.

In order to have higher printing sensitivity as well as obtain high image quality with no uneven density and white dropout, it is preferable that a layer having fine voids (also referred to as a fine void resin layer) exists. As the fine void resin layer, plastic film and synthetic paper having fine voids inside thereof can be used. The fine void resin layer can be formed on various supports by various coating modes. As the plastic film or the synthetic paper having the fine voids, the plastic film or the synthetic paper obtained by using polyolefin, particularly polypropylene as a main body, blending an inorganic pigment and/or a polymer which is incompatible with polypropylene therewith, using these as a void formation initiator, and stretching/making these into film is preferable. When polyester is used as the main body, the printing sensitivity is inferior and the uneven density easily occurs because its cushion property and adiathermancy are inferior because of its visco-elastic and thermal natures compared to those whose main body is polypropylene.

Considering these points, an elastic modulus of the plastic film and the synthetic paper is preferably $5\times10^8$ to $1\times10^{10}$ Pa at 20° C. These plastic film and synthetic paper are typically made as biaxially-oriented films, and thus shrink by heating. When these are left stand for 60 seconds at 110° C., their shrinkage percentage is 0.5 to 2.5%. The aforementioned plastic film and the synthetic paper may be a single layer as such comprising the fine voids or may be a multilayer constitution. In the case of the multilayer constitution, all of the layers may contain the fine voids, or the layer with no fine void may be contained. The white pigment as an opacifying agent may be mixed in the plastic film and the synthetic paper if necessary. In order to increase white color nature, the additives such as a fluorescent brightener may be contained. The thickness of the fine void resin layer is preferably 30 to 80 μm.

As the fine void resin layer, it is also possible to form the fine void resin layer on the substrate by a coating method. As the plastic resin used, it is possible to use the publicly known resin such as polyester, urethane resin, polycarbonate, acrylic resin, polyvinyl chloride and polyvinyl acetate alone or by blending two or more. The aforementioned various papers, synthetic paper, nonwoven fabric, plastic film and the like can be used for the support.

If necessary, for the purpose of preventing curl, a layer of the resin such as polyvinyl alcohol, polyvinylidene chloride, polyethylene, modified polyolefin, polyethylene terephthalate and polycarbonate or the synthetic paper can be provided on the side of the substrate, opposite to the side on which the image receiving layer is provided. As a pasting method, publicly known lamination methods such as dry lamination, non-solvent (hot melt) lamination and EC lamination can be used, and the preferable methods are the dry lamination and the non-solvent lamination. An adhesive agent suitable for the non-solvent lamination method includes, for example, Takenate 720L supplied from Takeda Pharmaceutical Co., Ltd. An adhesive agent suitable for the dry lamination includes, for example, Takelac A969/Takenate A-5 (3/1) supplied from Takeda Pharmaceutical Co., Ltd., and Polysol PSA SE-1400 and Vinylol PSA AV-6200 series supplied from Showa Highpolymer Co., Ltd. The amount of these adhesive agents to be used is in the range of 1 to 8 g/m$^2$, and preferably 2 to 6 g/m$^2$ in terms of the solid content.

When the plastic film and the synthetic paper as described above, or the plastic films one another or the synthetic papers one another, or various papers and the plastic film or the synthetic paper are laminated, they can be pasted together by the adhesive layer.

For the purpose of enhancing adhesive strength between the above support and the thermal transfer image receiving layer, it is preferable to give various primer treatments and corona discharge treatments onto the support surface.

(Layer Constitution, Coating Method and the Like)

The above thermal transfer image receiving layer can be formed by applying a coating solution obtained by dissolving or dispersing in a solvent such as water or organic solvent on the support by a usual method such as a bar coater, gravure printing method, screen printing method, roll coating method, reverse roll coating method using photogravure, air knife coating method, spray coating method, curtain coating method and extrusion coating method, and drying. The formation of the barrier layer, the intermediate layer and the backside layer is performed by the same method as in the case of the above image receiving layer. The image receiving layer is formed not only by directly applying the coating solution on the support and drying, and but also by transferring and forming onto the support from the image receiving layer previously formed on the other support. The respective layers can be formed by a simultaneous application method of two or more layers, and particularly, the simultaneous application where all of the layers are finished by one application can be also performed.

The thickness of the image-receiving layer is preferably about 0.1 to 10 μm after applying and drying.

(Shape of Image Receiving Sheet)

The image receiving sheet used in the present invention may be supplied to a printer by sheets or a roll form. A sheet-fed form indicates, for example, a form where the image receiving sheet is cut into a constant size, one set of about 50 sheets is placed in a cassette, which is loaded in the printer to use. The roll form is a form where a roll shape of the image receiving sheet is supplied in the printer and is cut into the desired size after photographic printing to use. In particular, the latter is preferable because feeding trouble such as wrong paper supply such as two sheet feeding and wrong paper discharge is solved and the latter can address high capacity in numbers of printable sheets.

When the image receiving sheet is supplied in the roll form, in particular when the image receiving sheet is used as a postcard type, or label or seal type, it is possible to provide a detection mark on the backside in order to adjust a cut position to a position of a design mark such as post code or a position of half cut of the seal, formed on the backside.

(Chelate Recording Method)

Subsequently, one example of the thermal transfer recording method will be shown.

An embodiment in the case where the transparent protection layer or the non-transferable resin layer is supplied with the dye layer of the thermal transfer sheet in a phase sequential is described based on the drawings. In FIG. 1A, a yellow (Y), magenta (M) and cyan (C) dye layers 2, and in some cases, the transparent protection layer or the non-transferable resin layer are provided in a phase sequential on the same phase of a support 3.

Figure 1B:
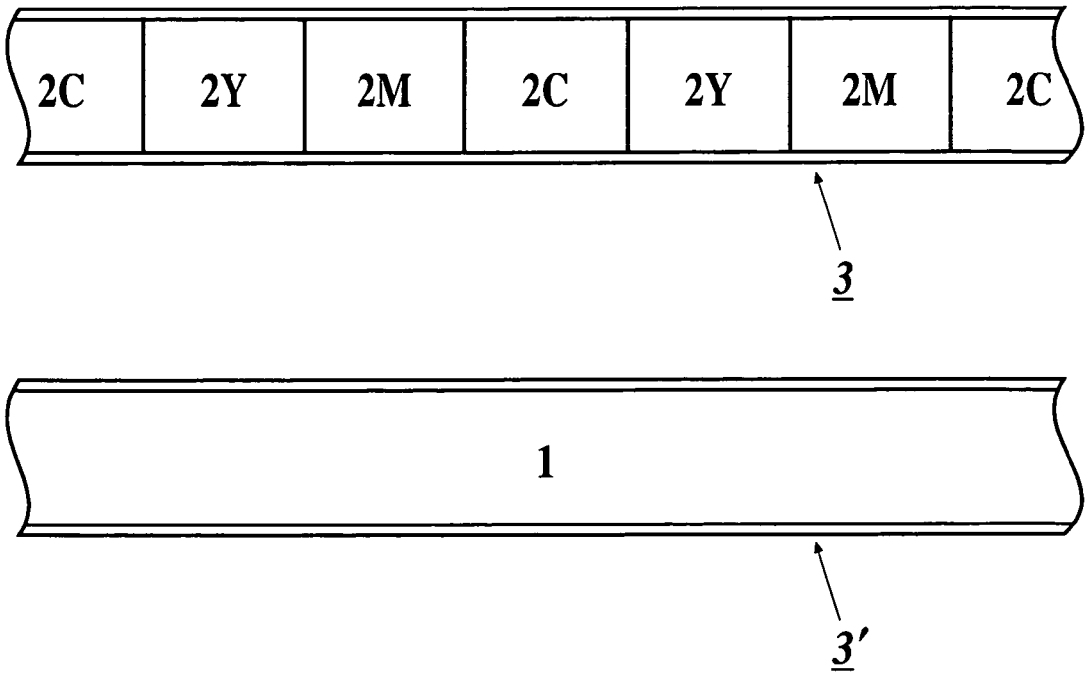

In FIGS. 1A and 1B, there is no space between respective layers, but the space may be appropriately provided in accordance with a control method of a thermal transfer recording apparatus. In order to allow a cue system for each layer to work well, it is preferable to provide the thermal transfer sheet with a detection mark, and it is not particularly limited how to provide the mark. In FIG. 1A, the dye layers and the transparent protection layer or the non-transferable resin layer were provided on the same phase of the support, but it certainly goes without saying that they may be provided on distinct supports, respectively. With respect to the definition of the dye layer, when the reactive dye is used, the dye per se contained in the dye layer is the compound before the reaction, and strictly saying, can not be expressed as the Y, M, or C dye, but in the meaning that the layer is one for finally forming a Y, M or C image, they are similarly expressed for convenience.

(Chelate Recording Apparatus)

Figure 2A:
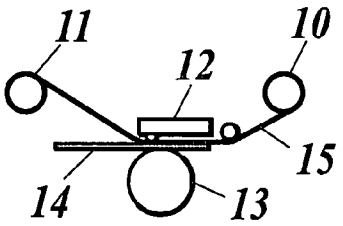
FIGS. 2A to 2C is a conceptual view of one example of a thermal transfer recording apparatus used for a method of the present invention.
Figure 2B:
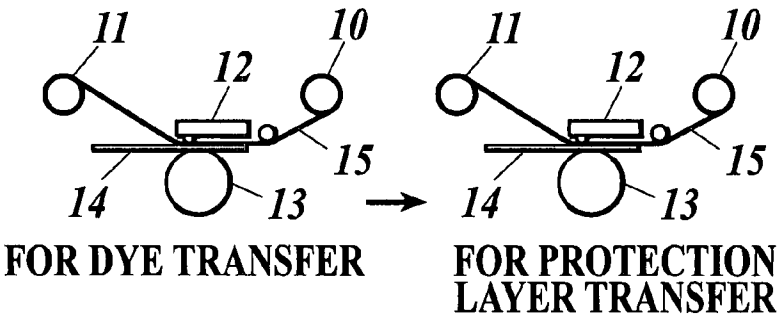
Figure 2C:
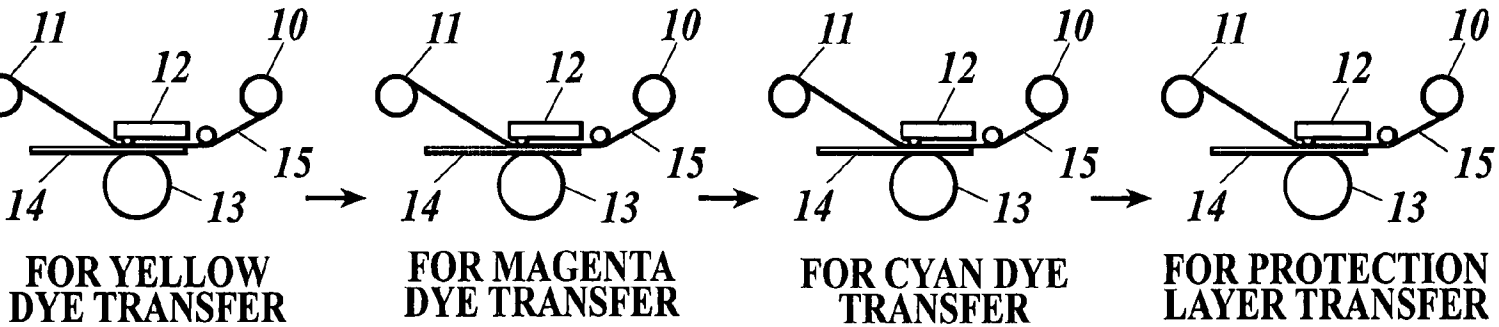

As the thermal transfer recording apparatus used for the present invention, for example, an apparatus shown in FIGS. 2A to 2C can be used. In FIG. 2A to 2C, 10 is a thermal transfer sheet supply roll, 15 is a thermal transfer sheet, 11 is a take up roll for taking up the thermal transfer sheet used, 12 is a thermal head, 13 is a platen roller, and 14 is an image receiving sheet inserted between the thermal head 12 and the platen roller 13.

In a thermal transfer printer used for the invention, when it is made possible to select the control of a gloss tone and a matte tone in the same printer, a photographic printing with desired surface property can be obtained in one model, and thus it is preferable. A method for the selection is not particularly limited. For example, control data corresponding to a definite gloss tone and matte tone may be saved in the thermal transfer recording apparatus, the control data selected by a simple operation of an operator may be read out and a control section may be controlled in accordance with the data. When a personal computer is connected to the printer, the control data may be save in the personal computer, and the control data selected by a simple operation of an operator may be sent out to the printer. Alternatively when heated by a thermal roller, a recorded body with different surface can be obtained by applying a material which modifies the surface, e.g., a release sheet which exerts gloss or a concavoconvex sheet for making the matte tone onto the image receiving layer surface after image recording, and heating by the thermal roller.

(Later Heating Method)

In the thermal transfer method of the invention, a heating step may be given to the recorded body obtained by the thermal transfer recording, after the image formation.

The heating after the image formation is performed for the purpose of fixing the transferred dyes within the image receiving layer for the thermal transfer recording.

A heating method includes a method using the thermal head used for the thermal transfer recording, a method using the thermal roller, a method by a heating heater or a hot wind heater, and a method by electron ray radiation or infrared ray radiation.

The heating of the recorded body can be performed from both front and back sides or one side, one side is heated, or both sides are heated simultaneously or by one by one side.

In the invention, the preferable heating method is the method using the thermal head or the method using the thermal roller.

EXAMPLES

The present invention will be more specifically described with reference to the following Examples, but the invention is not limited thereto.

Specific examples will be described below. In the text, "parts" or "%" is based on the mass unless otherwise indicated.

[Manufacture of Thermal Transfer Sheet (Also Referred to as an Ink Sheet) 1]

(Manufacture of Support A with Back Coat Layer)

A support A having a back coat layer with a dried film thickness of 1.0 μm was made by applying a back coat layer coating solution 1 composed of the following composition on one side of polyethylene terephthalate film (Lumirror supplied from Toray Industries, Inc.) with easy-adhering layer with a thickness of 4.5 μm by a gravure coating mode, drying, and subsequently performing a heat curing treatment.

<Preparation of Back Coat Layer Coating Solution 1>

| | |
|---|---|
| Polyvinyl butyral resin (S-Lec BX-1 supplied from Sekisui Chemical Co., Ltd.) | 3.5 parts by mass |
| Phosphate ester type surfactant (Plysurf A208S supplied from Dai-ichi Kogyo Seiyaku Co., Ltd.) | 3.0 parts by mass |
| Phosphate ester type surfactant (Phosphanol RD720 supplied from Toho Chemical Industry Co., Ltd.) | 0.3 parts by mass |
| Polyisocyanate (Barnock D750 Supplied from Dainippon Ink & Chemicals Mfg Co., Ltd.) | 19.0 parts by mass |
| Talc (supplied from Nippon Talc Co., Ltd., Y/X = 0.03) | 0.2 parts by mass |
| Methyl ethyl ketone | 35.0 parts by mass |
| Toluene | 35.0 parts by mass |

[Formation of Dye Layer, Protection Transfer Layer]

Figure 3:
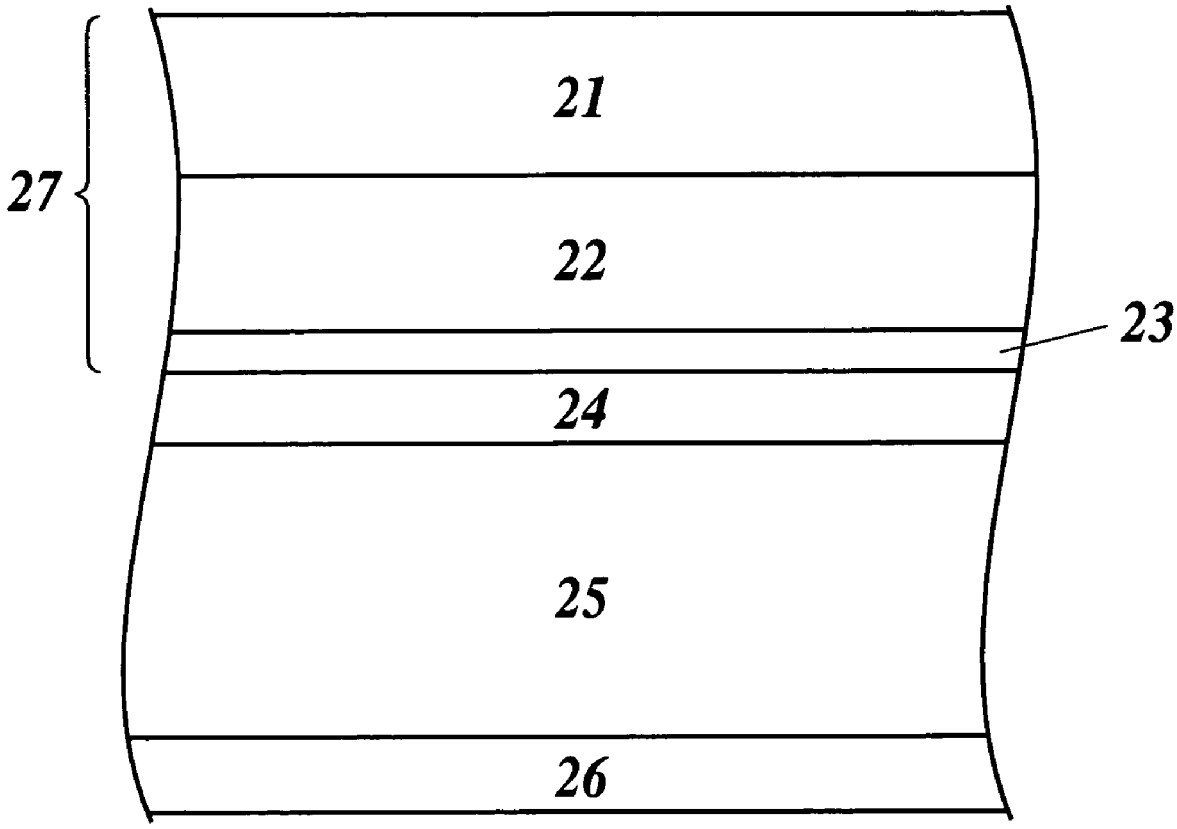
FIG. 3 is a schematic view showing a constitution of a thermal transfer sheet in Example.

A thermal transfer sheet 1 was made by providing respective dye layers 24 (dried film thickness: 1 μm) formed using a yellow dye coating solution 1, a magenta dye coating solution 1 and a cyan dye coating solution 1 composed of the following compositions, and a multilayer constitution protection transfer layer 27 (three layer constitution of a non-transferable release layer 23, a protection transfer layer 22 and an adhesive layer 21) by a gravure method, on the side opposite to the back coat side of the support A 25 with the back coat layer 26. The above layers are formed in a phase sequential as shown in FIG. 3.

[Respective Dye Layer]

<Yellow Dye Coating Solution 1>

| | |
|---|---|
| Post-chelate colorant (JP 2004-74617 A, Exemplified compound (1)-32) | 4.5 parts by mass |
| Polyvinyl acetoacetal resin (S-Lec KS-5 supplied from Sekisui Chemical Co., Ltd.) | 5.0 parts by mass |
| Urethane modified silicone resin (Diaromer SP-2105 supplied from Dainichiseika Color & Chemicals Mfg Co., Ltd.) | 0.5 parts by mass |
| Methyl ethyl ketone | 45.0 parts by mass |
| Toluene | 45.0 parts by mass |

<Magenta Dye Coating Solution 1>

| | |
|---|---|
| Post-chelate colorant (JP 2004-74617 A, Exemplified compound (2)-38) | 4.0 parts by mass |
| Polyvinyl acetoacetal resin (S-Lec KS-5 supplied from Sekisui Chemical Co., Ltd.) | 5.5 parts by mass |
| Urethane modified silicone resin (Diaromer SP-2105 supplied from Dainichiseika Color & Chemicals Mfg Co., Ltd.) | 0.5 parts by mass |
| Methyl ethyl ketone | 45.0 parts by mass |
| Toluene | 45.0 parts by mass |

<Cyan Dye Coating Solution 1>

| | |
|---|---|
| Post-chelate colorant, Exemplified compound 47 | 4.0 parts by mass |
| Polyvinyl acetoacetal resin (S-Lec KS-5 supplied from Sekisui Chemical Co., Ltd.) | 5.5 parts by mass |
| Urethane modified silicone resin (Diaromer SP-2105 supplied from Dainichiseika Color & Chemicals Mfg Co., Ltd.) | 0.5 parts by mass |
| Methyl ethyl ketone | 45.0 parts by mass |
| Toluene | 45.0 parts by mass |

[Multilayer Constitution Protection Transfer Layer]

(Non-transferable Release Layer)

A non-transferable release layer was formed by coating and drying a non-transferable release layer coating solution 1 composed of the following composition by a gravure coating method so that a solid content after drying was 0.5 g/m$^2$.

<Non-Transferable Release Layer Coating Solution 1>

| | |
|---|---|
| Colloidal silica (Snowtex 50 supplied from Nissan Chemical Industries Ltd.) | 1.5 parts by mass |
| Polyvinyl alcohol | 4.0 parts by mass |
| Ion-exchange water | 3.0 parts by mass |
| Modified ethanol | 10 parts by mass |

(Protection Transfer Layer)

A protection transfer layer was formed by coating and drying a protection transfer layer coating solution 1 composed of the following composition on the non-transferable release layer formed above by the gravure coating method so that the solid content after drying was 2.0 g/m$^2$.

<Protection Transfer Layer Coating Solution 1>

| | |
|---|---|
| Acrylic resin | 15 parts by mass |
| Vinyl chloride-vinyl acetate copolymer | 5 parts by mass |
| Copolymer resin reacting and binding a reactive ultraviolet ray absorbing agent (UVA-635L supplied from BASF Japan) | 40 parts by mass |
| Polyethylene wax | 0.3 parts by mass |
| Polyester resin | 0.1 parts by mass |
| Methyl ethyl ketone | 40 parts by mass |
| Toluene | 40 parts by mass |
| Zinc antimonate (Celnax supplied from Nissan Chemical Industries Ltd.) | 20 parts by mass |

(Adhesive Layer)

An adhesive layer was formed by coating and drying an adhesive layer coating solution 1 composed of the following composition on the protection transfer layer formed above by the gravure coating method so that the solid content after drying was 2.0 g/m$^2$.

<Adhesive Layer Coating Solution 1>

| | |
|---|---|
| Vinyl chloride-vinyl acetate copolymer | 20 parts by mass |
| Methyl ethyl ketone | 100 parts by mass |
| Toluene | 100 parts by mass |

By the above, the multilayer constitution protection transfer layer detachably comprising the protection transfer layer which was a laminate of the protection transfer layer and the adhesive layer was made on the non-transferable release layer.

<Manufacture of Thermal Transfer Sheets 2 to 6>

Thermal transfer sheets 2 to 6 where the cyan colorant in the thermal transfer sheet 1 was changed from the exemplified compound 47 to the exemplified compounds 26, 46, 49, 63 and the structural formula 1 were made.

<Manufacture of Thermal Transfer Sheet Comparisons 1, 2 and 3 (Comparison)>

Thermal transfer sheet comparison 1, 2 and 3 where the cyan colorant in the thermal transfer 1 was changed from the exemplified compound 47 to comparative colorants 1 and 2 were made. The thermal transfer sheets made are shown in Table 6.

TABLE 6

| INK SHEET | COLORANT | MOLECULAR WEIGHT |
|---|---|---|
| 1 | 47 | 379.5 |
| 2 | 26 | 407.55 |
| 3 | 46 | 409.52 |
| 4 | 49 | 407.55 |
| 5 | 63 | 411.5 |
| 6 | STRUCTURAL FORMULA (1) | 379.5 |
| COMPARISON 1 | COMPARATIVE COLORANT 1 | 471.59 |
| COMPARISON 2 | COMPARATIVE COLORANT 2 | 449.63 |
| COMPARISON 3 | COMPARATIVE COLORANT 3 | 379.5 |

[Manufacture of Thermal Transfer Image Receiving Sheet 1]

A thermal transfer image receiving sheet 1 was made in accordance with the followings.

(Manufacture of Support)

Coated paper (basis weight per meter square of 157 g/m$^2$, OK Top Coat supplied from Oji Paper Co., Ltd.) was used as a support of the image receiving sheet, and a corona discharge treatment was given onto one side thereof. Subsequently, on that side, as a backside resin layer, high density polyethylene (Jeylex LZ0139-2, density 0.952 supplied from Nippon Polyolefin Co., Ltd.)(abbreviated as HDPE) to which 15% by mass ethylene-α-olefin copolymer (Toughmer A-4085 suppled from Mitsui Petroleum Chemical Ind., Ltd.) had been blended and polypropylene (Jeyaromer LR7115, density 0.905, supplied from Nippon Polyolefin Co., Ltd.)(abbreviated as PP) were laminated by a co-extrusion coating method in which two layers were co-extruded by multilayer T die known publicly so that the HDPE side was contacted with the coated paper. On the PP side which was an outer side, after giving the corona discharge treatment, a backside layer coating solution 1 composed of the following composition was applied and dried so that a dried solid content was 1.5 g/m$^2$ to make the support B. The backside resin layer was processed so that the thickness of the HDPE layer with ethylene-α-olefin copolymer blend was 14 μm, the thickness of the PP layer was 19 μm and the total thickness was 33 μm.

<Preparation of Backside Layer Coating Solution 1>

| | |
|---|---|
| Acrylic resin (BR-85 supplied from Mitsubishi Rayon Co., Ltd.) | 19.8 parts by mass |
| Nylon filler (MW-330 supplied from Shinto Paint Co., Ltd.) | 0.6 parts by mass |
| Methyl ethyl ketone | 39.8 parts by mass |
| Toluene | 39.8 parts by mass |

(Manufacture of Thermal Transfer Image Receiving Sheet)

Meanwhile, as a resin layer having fine voids, foamed polypropylene sheet with a thickness of 35 μm (35MW846 supplied from Mobil Plastics Europe) was used, and on one side thereof, an intermediate layer coating solution and a coating solution for a dye image-receiving layer composed of the following compositions were sequentially applied by a gravure reverse coating method and dried so that each film thickness was 1 μm and 3 μm to make the foamed polypropylene sheet on which the intermediate layer and the dye image-receiving layer were laminated.

Subsequently, the thermal transfer image receiving sheet 1 was made by pasting the surface at the side opposite to the intermediate layer and the dye image-receiving layer of the above foamed polypropylene sheet (foamed polypropylene sheet surface) together with the surface at the side opposite to the backside resin layer of the above support B (coated paper surface) using an adhesive agent of the following composition by a dry laminate method.

<Preparation of Intermediate Layer Coating Solution>

| | |
|---|---|
| Urethane type resin (Nippolan 5199 supplied from Nippon Polyurethane Industry Co., Ltd.) | 5.7 parts by mass |
| Titanium oxide (TCA888 supplied from Tochem products Co., Ltd.) | 11.4 parts by mass |
| Fluorescent brightener (Ubitex OB supplied from Nihon Ciba-Geigy K.K.) | 0.2 parts by mass |
| Isocyanate (Takenate A-14 supplied from Takeda Pharmaceutical Co., Ltd.) | 2.0 parts by mass |
| Methyl ethyl ketone | 15.5 parts by mass |
| Toluene | 15.5 parts by mass |
| Isopropyl alcohol | 7.7 parts by mass |

<Preparation of Dye Image-Receiving Layer Coating Solution>

| | |
|---|---|
| Vinyl chloride-vinyl acetate copolymer (Denka Vinyl #1000A supplied from Denki Kagaku Kogyo K.K.) | 7.2 parts by mass |
| Vinyl chloride-styrene-acryl copolymer (Denka Lac #400 supplied from Denki Kagaku Kogyo K.K.) | 1.6 parts by mass |
| Polyester (Byron 600 supplied from Toyobo Co., Ltd.) | 11.2 parts by mass |
| Metal source (General formula VI, Exemplified compound (VI)-1 | 8.0 parts by mass |
| Vinyl modified silicone (X621212 supplied from Shin-Etsu Chemical Co., Ltd.) | 2.0 parts by mass |
| Catalyst: CAT PLR-5 (supplied from Shin-Etsu Chemical Co., Ltd.) | 1.0 part by mass |
| Catalyst: CAT PL50T (supplied from Shin-Etsu Chemical Co., Ltd.) | 1.2 part by mass |
| Solvent: methyl ethyl ketone | 39.0 parts by mass |
| Solvent: toluene | 39.0 parts by mass |

<Manufacture of Image Receiving Sheets 2 to 4>

Image receiving sheets 2 to 4 where the metal source in the image receiving layer coating solution in the image receiving sheet 1 was changed from VI-1 to VI-2, VI-5 and VI-7 were made. An amount of the metal source to be added was determined depending on a molecular weight so that a content of metal ions became equal.

The image receiving sheets made are shown in Table 7.

TABLE 7

| IMAGE RECEIVING SHEET | MS |
|---|---|
| 1 | VI-1 |
| 2 | VI-2 |
| 3 | VI-5 |
| 4 | VI-7 |

Example 1

In a thermal transfer recording apparatus having a square shaped resistive element (major scanning direction length 80 μm×minor scanning direction length 120 μm) and loaded with a thermal head with 300 dpi (dpi represents the number of dots per 2.54 cm) of line heads, an image receiving layer of the thermal transfer image receiving sheet 1 and ink layers of the thermal transfer sheets 1 to 6 and the comparisons 1 and 2 were set by lapping. An image was formed by heating respective step patterns of yellow, magenta, cyan and neutral (three layers of the yellow, magenta and cyan) sequentially increased within 580 mJ/mm$^2$ of applied energy at a feed rate of 10 msec/line and at a feed length of 85 μm per line from the backside of the ink layers as pressurizing with the thermal head and a platen roll to transfer respective colorants onto the image receiving layer of the thermal transfer image receiving sheet.

Subsequently, using the same thermal transfer recording apparatus as that used for the image formation, photographic printing samples 1-1-1 to 1-1-6 and 1-1-comparisons 1 and 2 were made by lapping the multilayer constitution protection transfer layer made above over the image receiving sheet on which the image had been formed, and heating them from the backside of the protection layer transfer sheet at an applied energy of 80 mJ/mm$^2$ and at a feed rate of 10 msec/line as pressurizing with the thermal head and the platen roll to transfer the protection sheet on the entire image surface of the image receiving sheet.

In the same way, concerning the image receiving sheets 2 to 4, the samples 1-2-1 to 1-4-6 and 1-2 comparisons 1-2 to 1-4-comparisons 1 and 2 on which the image had been formed were made.

(Sensitivity, Light Resistance, Moisture Resistance, Heat Resistance, Yellowing, Image Bleeding)

With respect to the samples made above, a density Ci after the transfer was measured using X-rite 310. Subsequently xenon light at 85000 Lux was irradiated for 14 days using a weather meter supplied from Atlas, and then the density Cf was measured again to obtain a colorant remaining rate (Cf/Ci)×100

Maximum density (Dmax) value for the cyan and the neutral were shown.

The energy which gave 1.0 of the cyan density and the neutral density were represented by relative values. In this case, 1-1-Comparison 1 was a standard. The lower the value indicates the higher sensitivity.

With respect to all densities of the cyan and the neutral, when the colorant remaining rate is 90% or more, 80% or more and 70% or more, A, B and C were given to the light resistance, respectively.

For the samples made above, change in white background and color bleeding were visually evaluated when left stand under a high temperature and high humidity condition at 60° C. and 90% RH for 14 days and under a high temperature condition at 77° C. for 14 days.

Change in White Background

A: No yellowing

B: Yellowing was observed

Color Bleeding

A: Absence

B: Presence (Raw Stock Stability)

The thermal transfer ink sheets 1 to 6 and the comparisons 1 and 2 after storing under the condition at a) 40° C., 80% RH for 100 hours or b) 55° C., 10% RH for 48 hours were visually observed, and whether there was a change such as precipitation of the colorant was evaluated.

A: No change under both conditions of a) and b).

B: Slight turbidity was observed under either condition of a) or b).

C: Precipitation was evidently observed under both conditions of a) and b).

The above results are shown in Tables 8A to 8C.

TABLE 8A

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE | MOISTURE AND HEAT RESISTANCE: CHANGE OF WHITE BACK-GROUND | MOISTURE AND HEAT RESISTANCE: COLOR BLEEDING | RAW STOCK STABILITY | REMARKS |
|---|---|---|---|---|---|---|---|---|---|---|---|
| 1-1-1 | VI-1 | 47 | 2.58 | 2.34 | 0.74 | 0.76 | A | A | A | A | PRESENT INVENTION |
| 1-1-2 | VI-1 | 26 | 2.54 | 2.30 | 0.75 | 0.76 | A | A | A | A | PRESENT INVENTION |
| 1-1-3 | VI-1 | 46 | 2.50 | 2.26 | 0.77 | 0.78 | A | A | A | A | PRESENT INVENTION |
| 1-1-4 | VI-1 | 49 | 2.55 | 2.31 | 0.75 | 0.77 | A | A | A | A | PRESENT INVENTION |
| 1-1-5 | VI-1 | 63 | 2.48 | 2.24 | 0.78 | 0.79 | B | A | A | A | PRESENT INVENTION |
| 1-1-6 | VI-1 | STRUCTURAL FORMULA 1 | 2.61 | 2.35 | 0.73 | 0.75 | A | A | A | A | PRESENT INVENTION |
| 1-2-1 | VI-2 | 47 | 2.61 | 2.36 | 0.75 | 0.76 | A | A | A | A | PRESENT INVENTION |
| 1-2-2 | VI-2 | 26 | 2.54 | 2.30 | 0.77 | 0.78 | B | A | A | A | PRESENT INVENTION |
| 1-2-3 | VI-2 | 46 | 2.50 | 2.28 | 0.78 | 0.79 | B | A | A | A | PRESENT INVENTION |
| 1-2-4 | VI-2 | 49 | 2.58 | 2.32 | 0.76 | 0.77 | A | A | A | A | PRESENT INVENTION |
| 1-2-5 | VI-2 | 63 | 2.48 | 2.26 | 0.79 | 0.80 | B | A | A | A | PRESENT INVENTION |

TABLE 8B

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE | MOISTURE AND HEAT RESISTANCE: CHANGE OF WHITE BACK-GROUND | MOISTURE AND HEAT RESISTANCE: COLOR BLEEDING | RAW STOCK STABILITY | REMARKS |
|---|---|---|---|---|---|---|---|---|---|---|---|
| 1-2-6 | VI-2 | STRUCTURAL FORMULA 1 | 2.65 | 2.40 | 0.74 | 0.76 | A | A | A | A | PRESENT INVENTION |
| 1-3-1 | VI-5 | 47 | 2.64 | 2.38 | 0.73 | 0.74 | A | A | A | A | PRESENT INVENTION |
| 1-3-2 | VI-5 | 26 | 2.60 | 2.34 | 0.75 | 0.77 | A | A | A | A | PRESENT INVENTION |
| 1-3-3 | VI-5 | 46 | 2.56 | 2.30 | 0.77 | 0.78 | A | A | A | A | PRESENT INVENTION |
| 1-3-4 | VI-5 | 49 | 2.61 | 2.34 | 0.74 | 0.75 | A | A | A | A | PRESENT INVENTION |
| 1-3-5 | VI-5 | 63 | 2.51 | 2.26 | 0.78 | 0.79 | A | A | A | A | PRESENT INVENTION |
| 1-3-6 | VI-5 | STRUCTURAL FORMULA 1 | 2.69 | 2.42 | 0.72 | 0.74 | A | A | A | A | PRESENT INVENTION |
| 1-4-1 | VI-7 | 47 | 2.69 | 2.40 | 0.72 | 0.73 | A | A | A | A | PRESENT INVENTION |
| 1-4-2 | VI-7 | 26 | 2.63 | 2.34 | 0.73 | 0.75 | A | A | A | A | PRESENT INVENTION |
| 1-4-3 | VI-7 | 46 | 2.65 | 2.38 | 0.75 | 0.76 | A | A | A | A | PRESENT INVENTION |
| 1-4-4 | VI-7 | 49 | 2.64 | 2.34 | 0.73 | 0.74 | A | A | A | A | PRESENT INVENTION |

TABLE 8C

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE | MOISTURE AND HEAT RESISTANCE: CHANGE OF WHITE BACK-GROUND | MOISTURE AND HEAT RESISTANCE: COLOR BLEED-ING | RAW STOCK STA-BILITY | REMARKS |
|---|---|---|---|---|---|---|---|---|---|---|---|
| 1-4-5 | VI-7 | 63 | 2.60 | 2.30 | 0.77 | 0.78 | A | A | A | A | PRESENT INVENTION |
| 1-4-6 | VI-7 | STRUCTURAL FORMULA 1 | 2.73 | 2.45 | 0.70 | 0.71 | A | A | A | A | PRESENT INVENTION |
| 1-1-COM-PARISON 1 | VI-1 | COMPARISON 1 | 2.31 | 2.09 | 1.0 | 1.00 | C | B | B | C | COMPARATIVE EXAMPLE |
| 1-1-COM-PARISON 2 | VI-1 | COMPARISON 2 | 2.55 | 2.16 | 0.81 | 0.84 | B | A | A | A | COMPARATIVE EXAMPLE |
| 1-2-COM-PARISON 1 | VI-2 | COMPARISON 1 | 2.30 | 2.10 | 1.01 | 0.99 | C | B | B | B | COMPARATIVE EXAMPLE |
| 1-2-COM-PARISON 2 | VI-2 | COMPARISON 2 | 2.52 | 2.20 | 0.84 | 0.85 | C | B | A | A | COMPARATIVE EXAMPLE |
| 1-3-COM-PARISON 1 | VI-5 | COMPARISON 1 | 2.31 | 2.12 | 0.95 | 0.97 | C | A | A | A | COMPARATIVE EXAMPLE |
| 1-3-COM-PARISON 2 | VI-5 | COMPARISON 2 | 2.58 | 2.24 | 0.80 | 0.82 | A | A | A | A | COMPARATIVE EXAMPLE |
| 1-4-COM-PARISON 1 | VI-7 | COMPARISON 1 | 2.34 | 2.14 | 0.93 | 0.97 | B | A | A | A | COMPARATIVE EXAMPLE |
| 1-4-COM-PARISON 2 | VI-7 | COMPARISON 2 | 2.60 | 2.25 | 0.79 | 0.81 | A | A | A | A | COMPARATIVE EXAMPLE |
| 1-4-COM-PARISON 3 | VI-7 | COMPARISON 3 | 2.58 | 2.16 | 0.82 | 0.84 | A | A | A | A | COMPARATIVE EXAMPLE |

Example 2

<Manufacture of Thermal Transfer Sheets 7 to 12>

Thermal transfer sheets 7 to 12 were made by changing an amount of the binder so that a mass density of cyan colorant in the thermal transfer sheets 1 to 6 in Example 1 became 1.4 times.

<Manufacture of Thermal Transfer Sheets Comparisons 4, 5 and 6 (Comparison)>

Thermal transfer sheet comparisons 4, 5 and 6 were made by changing an amount of the binder so that a mass density of cyan colorant in the thermal transfer sheet comparisons 1, 2 and 3 in Example 1 became 1.4 times. The thermal transfer sheets made are shown in Table 9.

TABLE 9

| INK SHEET | COLORANT | MOLECULAR WEIGHT |
|---|---|---|
| 7 | 47 | 379.5 |
| 8 | 26 | 407.55 |
| 9 | 46 | 409.52 |
| 10 | 49 | 407.55 |
| 11 | 63 | 411.5 |
| 12 | STRUCTURAL FORMULA 1 | 379.5 |
| COMPARISON 4 | COMPARATIVE COLORANT 1 | 471.59 |
| COMPARISON 5 | COMPARATIVE COLORANT 2 | 449.63 |
| COMPARISON 6 | COMPARATIVE COLORANT 3 | 379.5 |

The comparative colorants 1, 2 and 3 of the cyan colorants used for the comparison of the samples are as follows.

Comparative colorant 1

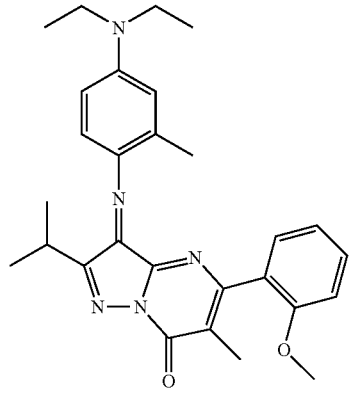

$C_{28}H_{33}N_5O_2$
Mol. Wt.: 471.59

Comparative colorant 2

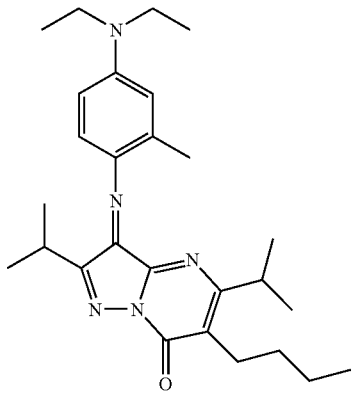

$C_{27}H_{39}N_5O$
Mol. Wt.: 449.63

-continued

Comparative colorant 3

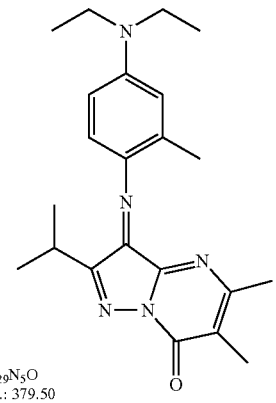

$C_{22}H_{29}N_5O$
Mol. Wt.: 379.50

Samples were made by transferring the colorants (dyes) onto the image receiving sheets 1 to 4 via the thermal transfer sheets 7 to 12 and the comparisons 4, 5 and 6 using the thermal head by the same way as in Example 1.

For these samples, the maximum transfer density, sensitivity, light resistance, change in white background and color bleeding were evaluated by the same way as in Example 1.

The thermal transfer ink sheets 7 to 12 and the comparisons 4, 5 and 6 after storing under the condition at a) 40° C., 80% RH for 100 hours or b) 55° C., 10% RH for 48 hours were visually observed, and whether there was a change such as precipitation of the colorant was evaluated by the same way as in Example 1.

The results are shown in Tables 10A to 10C.

TABLE 10A

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE | MOISTURE AND HEAT RESISTANCE: CHANGE OF WHITE BACK-GROUND | MOISTURE AND HEAT RESISTANCE: COLOR BLEEDING | RAW STOCK STABILITY | REMARKS |
|---|---|---|---|---|---|---|---|---|---|---|---|
| 2-1-7 | VI-1 | 47 | 2.6 | 2.35 | 0.65 | 0.66 | A | A | A | A | PRESENT INVENTION |
| 2-1-8 | VI-1 | 26 | 2.55 | 2.31 | 0.67 | 0.69 | B | A | A | A | PRESENT INVENTION |
| 2-1-9 | VI-1 | 46 | 2.52 | 2.28 | 0.67 | 0.68 | B | A | A | A | PRESENT INVENTION |
| 2-1-10 | VI-1 | 49 | 2.57 | 2.33 | 0.66 | 0.67 | A | A | A | A | PRESENT INVENTION |
| 2-1-11 | VI-1 | 63 | 2.5 | 2.25 | 0.68 | 0.69 | B | A | A | A | PRESENT INVENTION |
| 2-1-12 | VI-1 | STRUCTURAL FORMULA 1 | 2.64 | 2.37 | 0.64 | 0.65 | A | A | A | A | PRESENT INVENTION |
| 2-2-7 | VI-2 | 47 | 2.64 | 2.37 | 0.66 | 0.67 | A | A | A | A | PRESENT INVENTION |
| 2-2-8 | VI-2 | 26 | 2.57 | 2.32 | 0.67 | 0.69 | B | A | A | A | PRESENT INVENTION |
| 2-2-9 | VI-2 | 46 | 2.51 | 2.30 | 0.70 | 0.72 | B | A | A | A | PRESENT INVENTION |
| 2-2-10 | VI-2 | 49 | 2.6 | 2.35 | 0.68 | 0.7 | A | A | A | A | PRESENT INVENTION |
| 2-2-11 | VI-2 | 63 | 2.48 | 2.26 | 0.72 | 0.73 | B | A | A | A | PRESENT INVENTION |

TABLE 10B

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE | MOISTURE AND HEAT RESISTANCE: CHANGE OF WHITE BACK-GROUND | MOISTURE AND HEAT RESISTANCE: COLOR BLEEDING | RAW STOCK STABILITY | REMARKS |
|---|---|---|---|---|---|---|---|---|---|---|---|
| 2-2-12 | VI-2 | STRUCTURAL FORMULA 1 | 2.68 | 2.42 | 0.65 | 0.67 | A | A | A | A | PRESENT INVENTION |
| 2-3-7 | VI-5 | 47 | 2.66 | 2.40 | 0.62 | 0.63 | A | A | A | A | PRESENT INVENTION |
| 2-3-8 | VI-5 | 26 | 2.61 | 2.35 | 0.63 | 0.65 | A | A | A | A | PRESENT INVENTION |
| 2-3-9 | VI-5 | 46 | 2.58 | 2.32 | 0.65 | 0.66 | A | A | A | A | PRESENT INVENTION |

TABLE 10B-continued

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE | MOISTURE AND HEAT RESISTANCE: CHANGE OF WHITE BACKGROUND | MOISTURE AND HEAT RESISTANCE: COLOR BLEEDING | RAW STOCK STABILITY | REMARKS |
|---|---|---|---|---|---|---|---|---|---|---|---|
| 2-3-10 | VI-5 | 49 | 2.64 | 2.36 | 0.64 | 0.66 | A | A | A | A | PRESENT INVENTION |
| 2-3-11 | VI-5 | 63 | 2.53 | 2.27 | 0.67 | 0.68 | A | A | A | A | PRESENT INVENTION |
| 2-3-12 | VI-5 | STRUCTURAL FORMULA 1 | 2.71 | 2.43 | 0.61 | 0.63 | A | A | A | A | PRESENT INVENTION |
| 2-4-7 | VI-7 | 47 | 2.72 | 2.42 | 0.62 | 0.64 | A | A | A | A | PRESENT INVENTION |
| 2-4-8 | VI-7 | 26 | 2.64 | 2.35 | 0.63 | 0.65 | A | A | A | A | PRESENT INVENTION |
| 2-4-9 | VI-7 | 46 | 2.68 | 2.40 | 0.65 | 0.66 | A | A | A | A | PRESENT INVENTION |
| 2-4-10 | VI-7 | 49 | 2.66 | 2.35 | 0.64 | 0.66 | A | A | A | A | PRESENT INVENTION |

TABLE 10C

| SAMPLE | METAL SOURCE | CYAN COLORANT | MAXIMUM DENSITY CYAN | MAXIMUM DENSITY BK | SENSITIVITY CYAN | SENSITIVITY BK | LIGHT RESISNTANCE |
|---|---|---|---|---|---|---|---|
| 2-4-11 | VI-7 | 63 | 2.62 | 2.31 | 0.67 | 0.68 | A |
| 2-4-12 | VI-7 | STRUCTURAL FORMULA 1 | 2.76 | 2.47 | 0.60 | 0.61 | A |
| 2-1-COMPARISON 4 | VI-1 | COMPARISON 1 | * | | * | | |
| 2-1-COMPARISON 5 | VI-1 | COMPARISON 2 | 2.6 | 2.20 | 0.73 | 0.74 | B |
| 2-2-COMPARISON 4 | VI-2 | COMPARISON 1 | * | | * | | |
| 2-2-COMPARISON 5 | VI-2 | COMPARISON 2 | 2.54 | 2.22 | 0.74 | 0.76 | C |
| 2-3-COMPARISON 4 | VI-5 | COMPARISON 1 | * | | * | | |
| 2-3-COMPARISON 5 | VI-5 | COMPARISON 2 | 2.6 | 2.27 | 0.71 | 0.72 | B |
| 2-4-COMPARISON 4 | VI-7 | COMPARISON 1 | * | | * | | |
| 2-4-COMPARISON 5 | VI-7 | COMPARISON 2 | 2.64 | 2.29 | 0.69 | 0.7 | B |
| 2-4-COMPARISON 6 | VI-7 | COMPARISON 3 | 2.60 | 2.17 | 0.76 | 0.78 | B |

| SAMPLE | MOISTURE AND HEAT RESISTANCE: CHANGE OF WHITE BACKGROUND | MOISTURE AND HEAT RESISTANCE: COLOR BLEEDING | RAW STOCK STABILITY | REMARKS |
|---|---|---|---|---|
| 2-4-11 | A | A | A | PRESENT INVENTION |
| 2-4-12 | A | A | A | PRESENT INVENTION |
| 2-1-COMPARISON 4 | | | | COMPARATIVE EXAMPLE |
| 2-1-COMPARISON 5 | A | A | A | COMPARATIVE EXAMPLE |
| 2-2-COMPARISON 4 | | | | COMPARATIVE EXAMPLE |
| 2-2-COMPARISON 5 | B | B | B | COMPARATIVE EXAMPLE |
| 2-3-COMPARISON 4 | | | | COMPARATIVE EXAMPLE |
| 2-3-COMPARISON 5 | A | A | A | COMPARATIVE EXAMPLE |
| 2-4-COMPARISON 4 | | | | COMPARATIVE EXAMPLE |
| 2-4-COMPARISON 5 | A | A | A | COMPARATIVE EXAMPLE |
| 2-4-COMPARISON 6 | A | A | B | COMPARATIVE EXAMPLE |

*enable to evaluate because of precipitation

From the above results, it has been shown that in the thermal transfer recording material of the invention, storage stability of the ink sheet is good and the obtained image is highly sensitive and that by the thermal transfer recording material of the invention, the stable image with high sensitivity, good storage stability and with completely no yellowing in the white background under high temperature and high humidity condition or under high temperature condition is obtained.

Example 3

Metal Chelate Colorant

Thermal transfer sheets were made using the metal chelate colorants in place of the post-chelate colorants used in the thermal transfer sheets made in Example 1. Types of the metal chelate colorants are as shown in the following Table 11.

Image receiving sheets were made by the same way as in Example 1, except that the metal source was removed from the composition of the image receiving sheets in Example 1.

Samples 3-1 to 3-10 were made by forming cyan images and neutral images using these thermal transfer sheets and image receiving sheets by the same way as in Example 1 using the thermal head.

The compounds (5)-13 and (6)-13 described in JP 2004-74618 A were used for the yellow and magenta colorants, respectively.

The samples according to the invention and the comparative samples were analyzed by the following methods, and the sensitivity upon the formation of metal chelate colorant images and toughness (light resistance, heat resistance, moisture resistance) of the image were evaluated. Energy which gave 1.0 to the cyan and neutral density of the comparison 1 was rendered standard values, and the sensitivity was represented by a relative value thereof. The results are shown in Table 12.

—Evaluation and Methods Thereof—

(Light Resistance)

Xenon light at 85000 Lux was irradiated to the resulting metal chelate colorant transfer image for 14 days. The light resistance was evaluated by a cyan colorant remaining rate (%) represented by $(D_1/D_0)\times100$ when the densities before and after the light irradiation were $D_0$ and $D_1$, respectively.

(Heat Resistance)

The resulting metal chelate colorant transfer image was stored under the condition at 77° C. and 10% RH for 14 days. The heat resistance was evaluated by a cyan colorant remaining rate (%) represented by $(D_2/D_0)\times100$ when the densities before and after the storage were $D_0$ and $D_2$, respectively.

(Moisture Resistance)

The resulting metal chelate colorant transfer image was stored under the condition at 60° C. and 90% RH for 14 days. The moisture resistance was evaluated by a cyan colorant remaining rate (%) represented by $(D_3/D_0)\times100$ when the densities before and after the storage were $D_0$ and $D_3$, respectively.

TABLE 11

| SAMPLE NO. | CYAN | COLORANT | MOLECULAR WEIGHT | METAL SOURCE | MOLECULAR WEIGHT | MOLECULAR WEIGHT OF CHELATE COLORANT |
|---|---|---|---|---|---|---|
| 3-1 | (2)-9 | 26 | 407.6 | VI-9 | 921.9 | 1737.0 |
| 3-2 | (3)-1 | 63 | 411.5 | VI-1 | 541.3 | 1364.3 |
| 3-3 | (3)-5 | 47 | 379.5 | VI-7 | 921.9 | 1680.9 |
| 3-4 | (4)-5 | 46 | 409.5 | VI-7 | 921.9 | 1740.9 |
| 3-5 | (5)-5 | 49 | 407.6 | VI-7 | 921.9 | 1737.0 |
| 3-6 | (6)-1 | STRUCTURAL FORMULA (1) | 379.5 | VI-1 | 541.3 | 1300.3 |
| 3-7 | (6)-2 | STRUCTURAL FORMULA (1) | 379.5 | VI-7 | 921.9 | 1680.9 |
| 3-8 | COMPARISON 1 | COMPARATIVE COLORANT 1 | 471.59 | VI-7 | 921.9 | 1865.0 |
| 3-9 | COMPARISON 2 | COMPARATIVE COLORANT 2 | 449.63 | VI-7 | 921.9 | 1821.1 |
| 3-10 | COMPARISON 3 | COMPARATIVE COLORANT 3 | 379.5 | VI-7 | 921.9 | 1821.1 |

TABLE 12

| SAMPLE | CYAN | SENSITIVITY | | LIGHT RESISTANCE | | HEAT RESISTANCE | | MOISTURE RESISTANCE | | |
|---|---|---|---|---|---|---|---|---|---|---|
| NO. | COLARANT | CYAN | BK | CYAN | BK | CYAN | BK | CYAN | BK | REMARKS |
| 3-1 | (2)-9 | 0.81 | 0.82 | 93 | 91 | 94 | 95 | 97 | 96 | PRESENT INVENTION |
| 3-2 | (3)-1 | 0.85 | 0.85 | 87 | 84 | 96 | 94 | 96 | 95 | PRESENT INVENTION |
| 3-3 | (3)-5 | 0.8 | 0.81 | 91 | 88 | 93 | 96 | 97 | 97 | PRESENT INVENTION |
| 3-4 | (4)-5 | 0.83 | 0.84 | 88 | 86 | 94 | 97 | 95 | 95 | PRESENT INVENTION |
| 3-5 | (5)-5 | 0.81 | 0.83 | 94 | 92 | 96 | 95 | 96 | 96 | PRESENT INVENTION |

TABLE 12-continued

| SAMPLE NO. | CYAN COLARANT | SENSITIVITY CYAN | SENSITIVITY BK | LIGHT RESISTANCE CYAN | LIGHT RESISTANCE BK | HEAT RESISTANCE CYAN | HEAT RESISTANCE BK | MOISTURE RESISTANCE CYAN | MOISTURE RESISTANCE BK | REMARKS |
|---|---|---|---|---|---|---|---|---|---|---|
| 3-6 | (6)-1 | 0.78 | 0.78 | 92 | 89 | 97 | 95 | 96 | 98 | PRESENT INVENTION |
| 3-7 | (6)-2 | 0.76 | 0.78 | 94 | 91 | 95 | 96 | 97 | 97 | PRESENT INVENTION |
| 3-8 | COMPARISON 1 | 1 | 1 | 84 | 79 | 92 | 93 | 96 | 96 | COMPARATIVE EXMAPLE |
| 3-9 | COMPARISON 2 | 0.89 | 0.92 | 90 | 86 | 93 | 92 | 94 | 95 | COMPARATIVE EXMAPLE |
| 3-10 | COMPARISON 3 | 0.91 | 0.93 | 91 | 87 | 94 | 93 | 93 | 94 | COMPARATIVE EXMAPLE |

As is evident from Table 12, it has been shown that the metal chelate colorant of the present invention is higher sensitive and more excellent in image toughness such as light resistance, heat resistance and moisture resistance than metal complex colorants known conventionally.

The entire disclosure of Japanese Patent Application No. 2004-197521 filed on Jul. 5, 2004, including specification, claims, drawings and summary are incorporated herein by reference.

What is claimed is:

1. A thermal transfer recording material comprising:

at least one colorant represented by the following general formula (III), (IV) or (V), General formula (III)

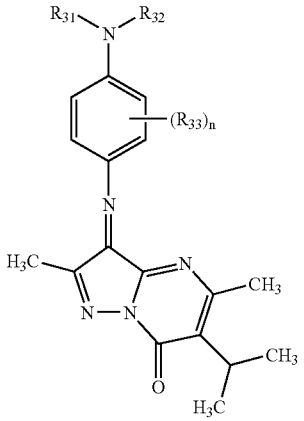

wherein $R_{31}$ and $R_{32}$ each represent a substituted or unsubstituted aliphatic group; $R_{33}$ represents a substituent; n represents an integer of 0 to 4; and when n is 2 or more, $R_{33}$ are the same or different each other;

General formula (IV)

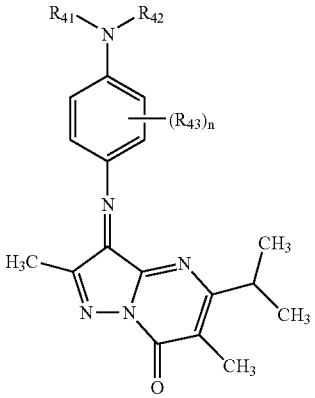

wherein $R_{41}$ and $R_{42}$ each represent a substituted or unsubstituted aliphatic group; $R_{43}$ represents a substituent; n represents an integer of 0 to 4; and when n is 2 or more, $R_{43}$ are the same or different each other, and General formula (V)

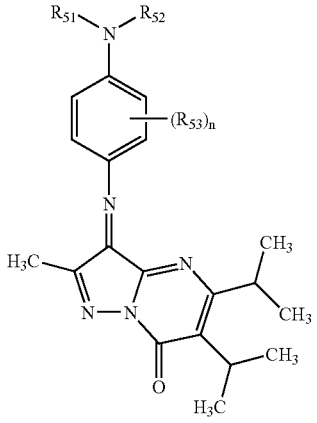

wherein $R_{51}$ and $R_{52}$ each represent a substituted or unsubstituted aliphatic group; $R_{53}$ represents a substituent; n represents an integer of 0 to 4; and when n is 2 or more, $R_{53}$ are the same or different each other.

2. The thermal transfer recording material of claim 1, wherein the colorant represented by at least one of the general formulae (III) to (V) has a molecular weight of 300 to 410.

3. The thermal transfer recording material of claim 2, wherein the colorant represented by the general formula (IV) has The following structural formula (1)

Structural formula (1)

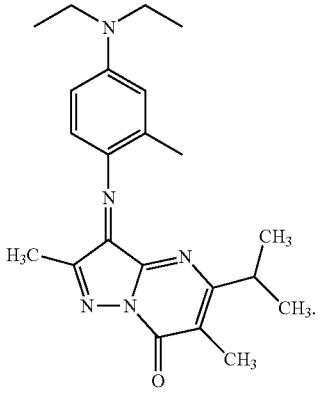

4. The thermal transfer recording material of claim 1, wherein the colorant represented by the general formula (IV) has the following structural formula (1)

Structural formula (1)

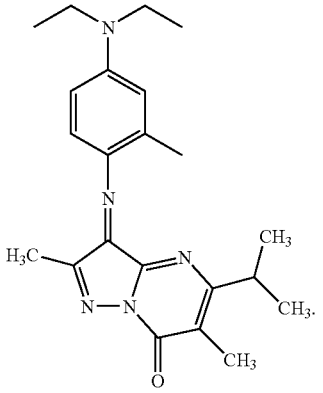

5. A thermal transfer recording method to form an image, comprising:

lapping an image receiving material over a thermal transfer recording material which comprises a colorant providing layer containing at least one colorant represented by The following general formula (III), (IV) or (V); and heating the thermal transfer recording material in accordance with image information, General formula (III)

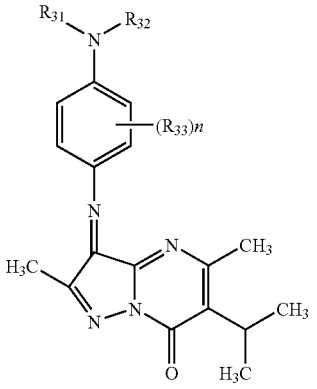

wherein $R_{31}$ and $R_{32}$ each represent a substituted or unsubstituted aliphatic group; $R_{33}$ represents a substituent; n represents an integer of 0 to 4; and when n is 2 or more, $R_{33}$ are the same or different each other;

General formula (IV)

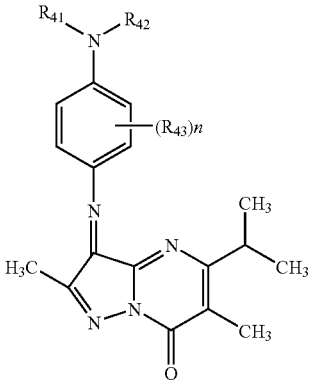

wherein $R_{41}$ and $R_{42}$ each represent a substituted or unsubstituted aliphatic group; $R_{43}$ represents a substituent; n represents an integer of 0 to 4; and when n is 2 or more, $R_{43}$ are the same or different each other, and General formula (V)

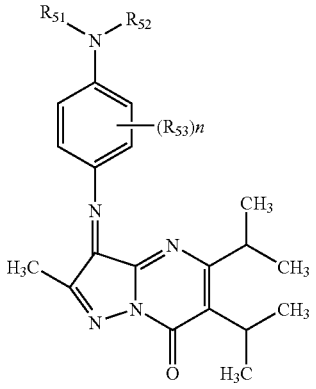

wherein $R_{51}$ and $R_{52}$ each represent a substituted or unsubstituted aliphatic group; $R_{53}$ represents a substituent; n represents an integer of 0 to 4; and when n is 2 or more, $R_{53}$ are the same or different each other.

6. The thermal transfer recording method of claim 5, wherein the image receiving material comprises a colorant image-receiving layer containing a metal ion-containing compound on a support, and the image is a metal chelate colorant image.

7. A thermal transfer recording material comprising: at least one metal chelate colorant generated by a reaction of a metal ion-containing compound with a colorant represented by the following general formula (III), (IV) or (IV), General formula (III)

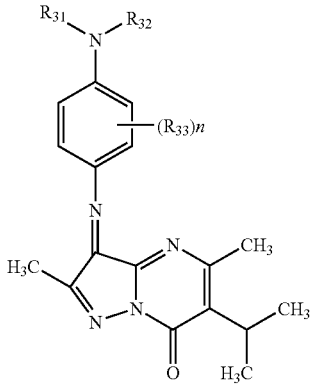

wherein $R_{31}$ and $R_{32}$ each represent a substituted or unsubstituted aliphatic group; $R_{33}$ represents a substituent; n represents an integer of 0 to 4; and when n is 2 or more, $R_{33}$ are the same or different each other;

General formula (IV)

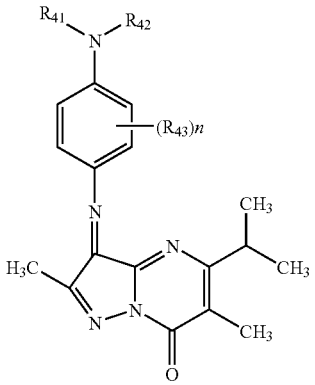

wherein $R_{41}$ and $R_{42}$ each represent a substituted or unsubstituted aliphatic group; $R_{43}$ represents a substituent; n represents an integer of 0 to 4; and when n is 2 or more, $R_{43}$ are the same or different each other, and General formula (V)

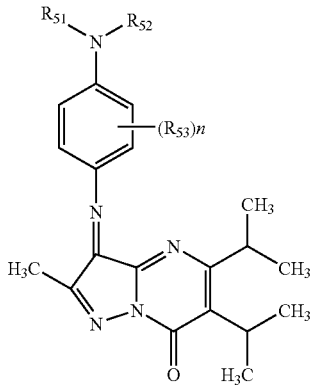

wherein $R_{51}$ and $R_{52}$ each represent a substituted or unsubstituted aliphatic group; $R_{53}$ represents a substituent; n represents an integer of 0 to 4; and when n is 2 or more, $R_{53}$ are the same or different each other.

8. A thermal transfer recording method using the thermal transfer recording material of claim 7.

* * * * *